US008226497B2

(12) United States Patent
Chu et al.

(10) Patent No.: US 8,226,497 B2
(45) Date of Patent: Jul. 24, 2012

(54) GOLF CLUB GRIP WITH AN AXIAL SEAM STRUCTURE

(76) Inventors: Hong-Sung Chu, Alhambra, CA (US); Chiung-Ling Wang Chu, Alhambra, CA (US)

( * ) Notice: Subject to any disclaimer, the term of this patent is extended or adjusted under 35 U.S.C. 154(b) by 200 days.

(21) Appl. No.: 12/590,506

(22) Filed: Nov. 9, 2009

(65) Prior Publication Data

US 2011/0111880 A1 May 12, 2011

(51) Int. Cl.
*A63B 53/14* (2006.01)

(52) U.S. Cl. ..... 473/300

(58) Field of Classification Search ..... 473/300–303
See application file for complete search history.

(56) References Cited

U.S. PATENT DOCUMENTS

| | | | |
|---|---|---|---|
| 3,311,375 | A | 3/1967 | Onions |
| 3,366,384 | A | 1/1968 | Lamkin et al. |
| 3,857,745 | A | 12/1974 | Grausch et al. |
| 6,656,057 | B2 | 12/2003 | Manual et al. |
| 6,857,971 | B2 | 2/2005 | Huang |
| 6,908,400 | B2 | 6/2005 | Chu et al. |
| 7,137,904 | B2 | 11/2006 | Huang |
| 7,438,646 | B2 | 10/2008 | Huang |
| 7,470,199 | B2 | 12/2008 | Huang |
| 7,491,133 | B2 | 2/2009 | Huang |
| 7,527,564 | B2 | 5/2009 | Huang |
| 2009/0258721 | A1 | 10/2009 | Huang |
| 2009/0258722 | A1 | 10/2009 | Huang |

OTHER PUBLICATIONS

Summons of U.S. Distric Court, Central Distric of California, Civil Action No. SACV06-66 DOC (MLGx) *Winn,Inc. and Ben Huang* v. *Compgrip USA Corp. and Hong-Sung Chu*. Dated Jan. 24, 2006.
Complaint for Patent Infringement and Demand for Jury Trial of Plaintiffs Winn,Inc. And Ben Huang, Filed Jan. 24, 2006.
Answer and counter claim of Defendants Compgrip USA Corp. and Hong-Sung Chu, Filed Mar. 8, 2006.
First amended answer & counter-claim of Defendants Compgrip USA Corp. and Hong-Sung Chu, Filed Mar. 31, 2006.
The May 5, 2006 opinion of Philip H. Haymond concerning alleged infringement of the U.S. patent 6,857,971 not included the exhibits referenced in this opinion [information marked confidenetial—AEO]. Relevant page appear at p. 25.
Compgrip USA Corp.'s and Hong-Sung Chu's responses to Winn, Inc.'s and Ben Huang 's First set of Interrogatories (1-14), Filed Aug. 2, 2006. Case #SACV06-66DOC (MLGx). [information marked confidential -Aeo ]. Relevant pages appear at pp. 6, 7, 8.
Compgrip USA Corp.'s and Hong-Sung Chu's Supplemental Responses to Winn, Inc.'s and Ben Huang's First Set of Interrogatories (1-14). [information marked confidential—AOE], filed Aug. 29, 2006, Relevant pages appear at pp. 6, 7, 8.

(Continued)

*Primary Examiner* — Stephen L. Blau

(57) ABSTRACT

A single sheet golf club grip comprises a single sheet layer wrapped around and adhered onto a sleeve body of an inner lining sleeve, an inner surface dimension of the sheet layer being longitudinally narrower than an outer surface dimension of the sleeve body to form an axial gap between two axial margins of the sheet layer, an axial seam structure including a seam strip and a plurality of flat binding surfaces along each side of the axial gap between the seam strip and each of the two axial margins to be strong enough to hold a single natural leather sheet to give the grip a soft, firm look and feel for slip resistance, a dense structure for torque resistance, and a durable gripping surface.

12 Claims, 23 Drawing Sheets

OTHER PUBLICATIONS

Winn, Inc.'s and Ben Huang's Response to Compgrip USA Corp's First Set of Interrogatories (Nos. 1-18), Filed Aug. 30,2006, Case #SACV 06-66DOC (MLGx). Relevant pages appear at pp. 3 & 4.

Minutes regarding Order on Plaintiffs' Motion for [partial] Summary Judgment dated Apr. 23, 2007 (Case #SACV 06-66 DOC (MLGx)) Relevant pages appear at pp. 7 to 10.

Corrected Request for Inter Partes Reexamination of U.S. Patent No. 6,857,971 issued to Ben Huang, filed by Hong-Sung Chu, Compgrip USA Corp, filed Apr. 23, 2007, assigned U.S. App. No. 95/000,234.

Final Consent Judgment and Permanent Injunction dated Jul. 13, 2007. ( Case # SACV 06-66 DOC (MLGx)). Relevant pages appear at pp. 1, 2.

Order Granting Request Inter Partes Reexamination, dated Jul. 16, 2007,(U.S. Appl. No. 95/000,234) from U.S. PTO.

U.S. Appl. No. 10/167,216's Request for Continued Examination and Amendment in Response to Notice of Allowability dated Mar. 16, 2006, filed Apr. 14, 2006. Relevant pages appear at pp. 8, 9, 12.

GOLF CLUB GRIP WITH AN AXIAL SEAM STRUCTURE

CROSS-REFERENCE TO RELATED APPLICATION

Not Applicable

BACKGROUND OF THE INVENTION

1. Field of the Invention

The invention relates to a golf club grip and a manufacturing method thereof, more particularly to a single sheet natural leather golf club grip with an axial seam structure and a manufacturing method thereof.

2. Description of the Related Art

The Applicant Hong-Sung Chu has successfully developed a single sheet anti-slip skin golf club grip with closed-cell foam tubular inner body with light weight, adequate rigidity and resilience, sufficient shock absorbing properties, and ease of installation (U.S. Pat. No. 6,656,057 filed on Jan. 23, 2002, granted to Manuel & The Applicant Hong-Sung Chu on Dec. 2, 2003). The Applicant Hong-Sung Chu has further developed a hem structure for a single sheet anti-slip skin layered golf club grip for finishing and hemming the marginal edges of a winding sheet layer (U.S. Pat. No. 6,908,400 filed on Aug. 5, 2003, granted to The Applicant Hong-Sung Chu & Chia-Hung Wu on Jun. 21, 2005, Now Expired). Two above mentioned U.S. patent's single sheet anti-slip skin that can be natural leather, synthetic leather, or Polyurethane synthetic leather.

Referring to FIG. 1, a golf club grip 1 is disclosed in a sixth embodiment of U.S. Pat. No. 6,908,400 FIG. 17, 18, 19 (not shown). The grip 1 has a seam straightening rib 111 located between its cap and protective rim so that two axial margins 101, 102 meet each other along a straight line defined by the seam straightening rib 111. An axial seam 13 is thus defined by the axial margins 101, 102. A seam strip 12 is inset bonded within a receiving groove 14 to finish the axial seam 13. This grip 1 has the flaws that are as followed:

1.) When the sheet layer 10 is wrapped around an inner sleeve body 11, there is a possibility that two axial margins 101,102 will form either a ridged 103 (FIG. 2) or an overlapped surface 104 (FIG. 3). This is due to the elasticity of the Polyurethane synthetic leather sheet layer 10. This ridged surface 103 or overlapped surface 104 will cause the seam strip 12 inset bonded improperly within the receiving groove 14 thereby increasing the manufacture defective rate during production.

2.) Its grip material of the sheet layer 10 is limited to the Polyurethane synthetic leather which is inferior to natural leather as a golf club grip material. (detailed as followed).

Golf club grips are the only direct link between the golf club and the player's body. The golf swing has been described as a "violent movement". Players must exert enough force on the golf club to enable the club head to travel fast and to make square contact with the ball at impact. It is thus imperative that the grip is made for the purpose of assisting a player to obtain a firm hold with torque resistance. In order to prevent the club from slipping or twisting out of the player's hands, it is crucial for the grip material, in its attempt to be an anti-slip skin layer, to have a soft and firm touch for slip resistance, stiff or dense gradient in structure for torque resistance, and a durable gripping surface.

The sixth embodiment of U.S. Pat. No. 6,908,400's Polyurethane synthetic leather is one of the conventional synthetic resin (polymers) leathers. Synthetic resin (polymers) leather and natural leather are very different structure wise. FIG. 4 shows a synthetic resin (polymers) leather 50 including an outer resin (polymers) layer 501, an inner base layer 502, and a binding layer 503. Polyurethane 501P can be an example of an outer resin (polymers) layer 501. The inner base layer 502 is made of man-made fibres 506 such as felt 502F, non-woven/woven fiber, textile, fabric or other artificial fibrous materials compounding with resin (polymers). The binding layer 503 is between the outer resin (polymers) layer 501 and the inner base layer 502. FIG. 6 is a Scanning Electronic Microscopic (SEM) 60× magnified picture of a Polyurethane/Felt synthetic resin leather which has a polyurethane layer 501P as its outer resin (polymers) layer 501, a felt layer 502F as its inner base layer 502, and its binding layer 503. Natural leather 52 is a material made from the hide or skin of animals by tanning processes. This skin is preferably cowhide, calf skin, sheep skin, or pig skin. The tanning process makes the potentially biodegradable skin into a long lasting and versatile natural material for various uses. Referring to FIGS. 5 and 7, natural leather 52 is composed of natural collagen fiber bundles 524 and has a fiber thickness and degree of interweaving which changes continuously. The collagen fiber bundles 524 stereoscopic structure consists of single collagen fibres 525 that twist with each other in a dense gradient manner. Natural leather 52 includes a grain layer 521 as a surface layer and an inner reticular layer 522 as a base layer. The grain layer 521 is thin yet dense in structure, covered with drawn tight collagen fiber surface 523 and has a natural brook web-like pattern. The inner reticular layer 522 is composed of the collagen fiber bundles 524, and has almost no boundary between the grain layer 521 and itself.

Referring to FIGS. 4 to 7, three differences in structure and features between synthetic resin (polymers) leather 50 and natural leather 52 are as followed:

1.) Surface Layer: Synthetic resin (polymers) leather 50's outer resin (polymers such as Polyurethane) layer 501 is used to simulate the grain layer 521 of natural leather 52. Its thickness is far thicker than the natural leather grain layer 521 and surface patterns are regular and uniform, lacking of the natural leather grain layer 521's brook web-like patterns. Therefore, outer resin (polymers such as Polyurethane) layer 501 has a soft, spongy feel with a cool plastic smooth touch, while, natural leather grain layer 521 features unique soft, firm look and feel.

2.) Base Layer: Synthetic resin (polymers) leather 50's inner base layer 502 is made out of man-made fibres 506 such as felt, nylon, textile, fabric or compound of polymers (such as Polyurethane) and other such artificial fibres to simulate natural leather 52's inner reticular layer 522. Due to the uniform orientation and interweaving structure of synthetic resin (polymers) leather inner base layer 502, the fibres of synthetic resin (polymers) leather is relatively loose. Conversely, natural leather inner reticular layer 522 is a dense interwoven material with the collagen fiber bundles 524 as mentioned above. Because of this, in regards to torque resistance for the golf club grip, synthetic resin (polymers) leather inner base layer 502 is much weaker than natural leather inner reticular layer 522.

3.) Transitive Layer: Synthetic resin (polymers) leather 50 has a weak binding layer 503 between the outer resin (polymers such as Polyurethane) layer 501's inner surface 504 and the inner base layer 502's outer surface 505. Outer resin (polymers such as Polyurethane) layer 501 tends to peel off from inner base layer 502 due to the weak binding layer 503. Natural leather 52 has no obvious boundary between the surface grain layer 521 and the inner reticular layer 522.

Above are the three most crucial differences in structure concerning the grip material in regards to the features in mind (soft, firm look and feel, dense in structure for torque resistance, and a durable gripping surface). None of the conventional synthetic resin (polymers) leathers 50 can compete with natural leather 52. Since natural leather 52 is denser and stiffer than synthetic resin (polymers) leather 50 material wise, the two axial margins of the natural leather sheet are harder to hold together than the synthetic resin (polymers) leather sheet in an axial seam of a single sheeted golf club grip. Therefore, it is the present invention's object to provide an improved axial seam structure to firmly hold a single sheet natural leather for use as a golf club grip (to be detailed later).

Aside from the grip 1 (FIG. 1), there are three other types of an axial seam structure for single sheet leather golf club grips. They are as follows:

1.) Sewn Axial Seam: Referring to FIG. 8, a single sheet golf club grip 2 is disclosed in U.S. Pat. No. 3,366,384 FIGS. 6 and 11 (not shown). The grip 2 has its single sheet leather 21's two axial edges 212, 213 inwardly sewn together by threads 22 face to face to form an axial seam 24.

2.) Adhered Axial Seam: FIG. 9, 10 both show a single sheet golf club grip 3, which is disclosed in U.S. Pat. No. 3,857,745 FIG. 5 (not shown). The grip 3 has its single sheet leather 31's two skived axial edges 312,313 adhered together through a skived overlapped adhesive joint 34 at a skived angle from the outer surface of one axial edge 313 to the inner surface of the opposing end of the axial edge 312 to form an axial seam 33. The two axial edges 312, 313 are also brought together face to face. Due to the skived and limited adherence surface of the two skived axial edges 312, 313, the bonding strength of axial seam 33 is very weak. This flaw is even more obvious if the single sheet natural leather 52 is used as a golf club grip material. This is due to the fact that the skived surface of said sheet of natural leather is made of natural collagen fiber bundles which are a non polymeric material with skived and limited adherence surface. It is the fact that non polymeric material is harder to adhere together than polymeric-layered synthetic resin (polymers) leathers. These two skived axial edges 312, 313 tend to burst out along the axial seam 33 during the installation of the grip 3. Also, along the skived axial edge 313, a sharp skived border 314 will be exposed on the surface of the grip 3. This sharp skived border 314 is so frail that the player's gripping fingers can easily tear it. Therefore, this Adhered Axial seam 33 needs a reinforcement mentioned in the next description.

3.) Reinforce-Adhered Axial Seam: Referring to FIG. 11, a single sheet golf club grip 4 has its two skived axial edges 412, 413 adhered together face to face through a skived overlapped adhesive joint 46. Both edges are then heat pressed to form a depressed reinforcement channel 45 which may be deposited with hot polyurethane 43 to form an axial seam 44. The grip 4 is disclosed in U.S. Pat. No. 7,491,133 FIGS. 45 and 65 (not shown).

The above prior arts, the grips 2, 3, 4, have two elements in common. Their axial edges 212/213, 312/313, 412/413 are brought together by either sewing or adhering them face to face and their inner surfaces' 211, 311, 411 configurations of the sheet layers 21,31, 41 relatively correspond to the outer surfaces' 231, 321, 421 shapes and dimensions of their sleeve body 23, 32, 42. These two elements will result in limiting their sleeve bodies' 23, 32, 42 expansion capacity during the installation of the grips 2, 3, 4, making it difficult to install the grips 2, 3, 4 onto the golf club shafts. This limited expansion also means that it is hard to increase the maximum grip size attainable which is an adjustment usually done by applying additional build up tape.

In regards to The Applicant Hong-Sung Chu previous invention U.S. Pat. No. 6,908,400 sixth embodiment's PU or PVC seam strip 13 in FIG. 1 and the prior art U.S. Pat. No. 7,491,133's axial channel 45 deposited with hot polyurethane 43 in FIG. 4, there is one particular flaw in appearance—they are obviously imitations of natural leather 52. This detracts from the natural beauty of the single sheet natural leather golf club grip.

SUMMARY OF THE INVENTION

It is the object of the present invention to provide a single sheet natural leather golf club grip along with an improved axial seam structure. This axial seam structure is strong enough to hold the single natural leather sheet's two axial margins together, to decrease the defective rate in production, and to enhance the expansion capacity of the grips in an effort to not only ease installation but also to increase the maximum grip size attainable.

It is another object of the present invention to reinforce the top and bottom ends of the axial seam structure.

It is still another object of the present invention to reinforce and receive both the top and bottom ends of the axial seam structure and the circumferential margins of the top and bottom of the natural leather sheet layer together respectively.

It is still another object of the present invention to provide a golf club grip with the soft, firm look and feel of natural leather.

According to one aspect of the present invention, a single sheet golf club grip comprises a single sheet layer wrapped around and adhered onto a sleeve body of an inner lining sleeve, an inner surface dimension of the sheet layer being longitudinally narrower than an outer surface dimension of the sleeve body to form an axial gap between two axial margins of the sheet layer, an axial seam structure including a seam strip and a plurality of flat binding surfaces along each side of the axial gap between the seam strip and each of the two axial margins to be strong enough to hold a single natural leather sheet to give the grip a soft, firm look and feel for slip resistance, a dense structure for torque resistance, and a durable gripping surface.

According to the same aspect of the present invention, a golf club grip comprises an inner lining sleeve, a single natural leather sheet layer, and a seam strip. The sheet layer of natural leather is wrapped around and adhered onto a sleeve body of the inner lining sleeve. The inner sleeve has a raised rib between its cap and protective rim. The sheet layer has an inner surface dimension longitudinally narrower than an outer surface dimension of the sleeve body to form an axial gap with the raised rib between the sheet layer's two axial margins and from the top circumferential margin to the bottom circumferential margin of the sheet layer. The seam strip is inset bonded onto each of the two axial margins and covers the axial gap and the raised rib to finish an axial seam structure.

According to another aspect of the present invention, the above two improved golf club grips are further secured with deposits of hot melt glue or sewn ties on top end and bottom end of the axial seam structures. Alternatively, the above two improved golf club grips can have a plurality of annular recesses respectively within the cap and the protective rim. These annular recesses are needed to cover and strengthen both ends of the axial seam structures as well as the top and bottom circumferential margins of the natural leather sheets.

According to another aspect of the present invention, the seam strip should also be natural leather to achieve the natural leather look and feel for the golf club grips.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

The present invention will be illustrated from FIGS. 12 to 49, wherein the same elements are represented with the same reference number.

Referring to FIGS. 12 to 21, a first embodiment of the present invention includes a golf club grip 6 mountable onto the end of golf club shaft. The golf club grip 6 includes an inner lining sleeve 7, a single natural leather sheet layer 8, and a seam strip 91.

Figure 1:
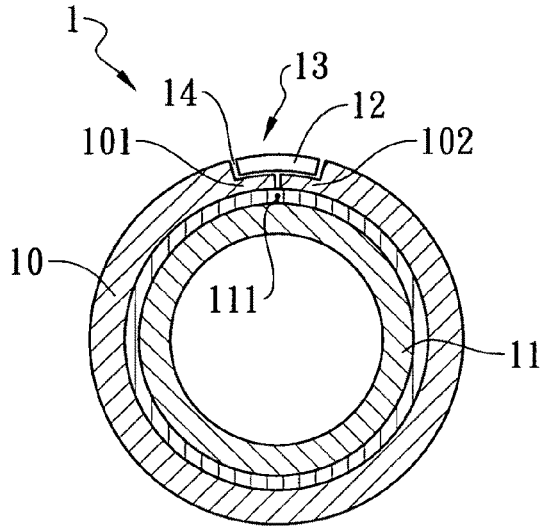
Fig. 1 Prior Art
FIG. 1 is a sectional view of a prior art.
Figure 2:
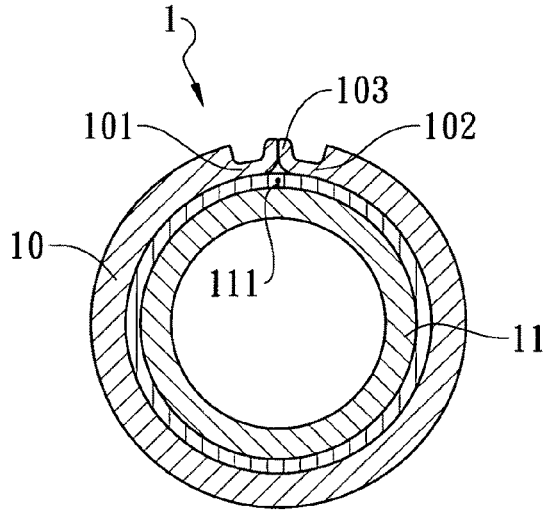
Fig. 2 Prior Art
FIG. 2 is a sectional view of the prior art FIG. 1's flaw.
Figure 3:
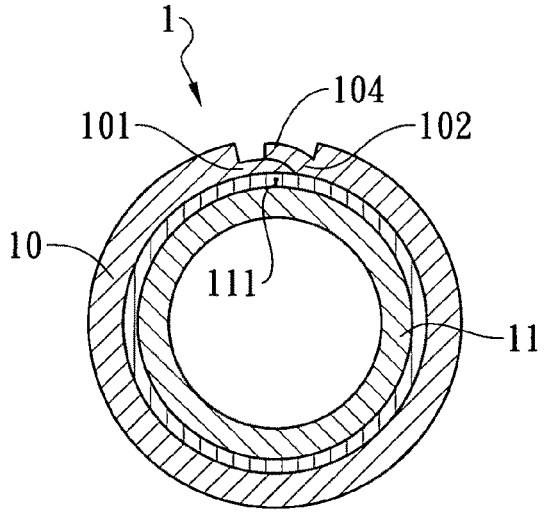
Fig. 3 Prior Art
FIG. 3 is a sectional view of the prior art FIG. 1's another flaw.
Figure 4:
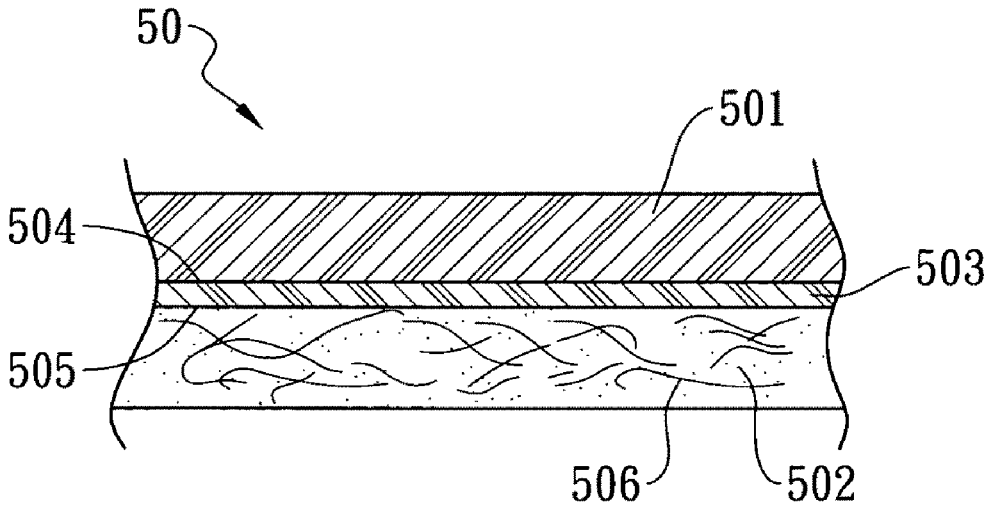
FIG. 4 is a sectional view of a piece of synthetic resin (polymers) leather.
Figure 5:
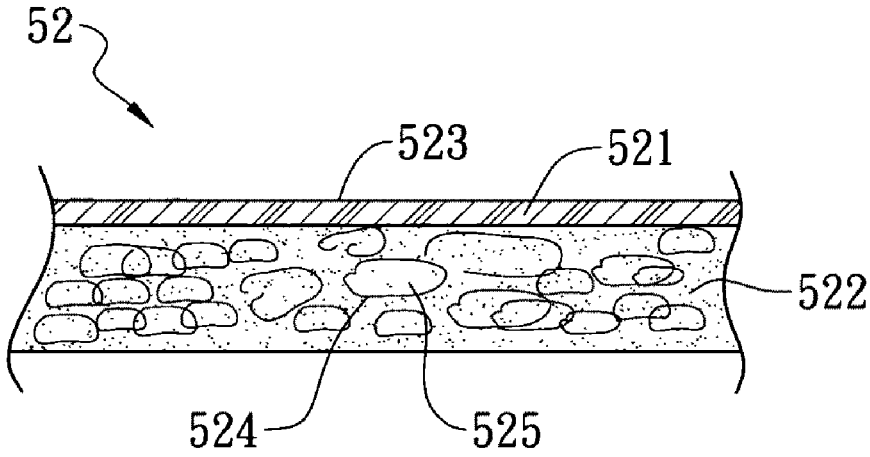
FIG. 5 is a sectional view of a piece of natural leather.
Figure 6:
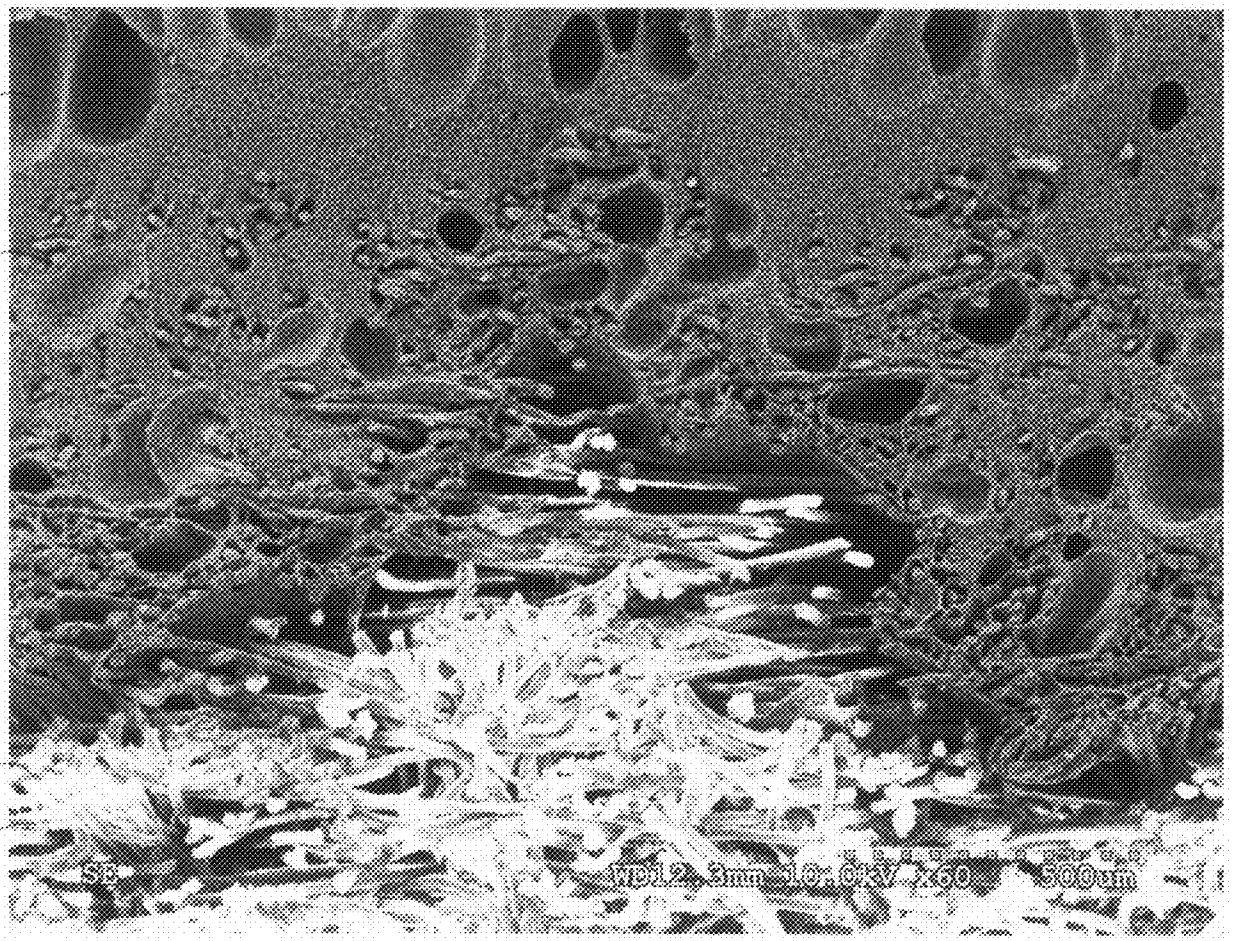
FIG. 6 is a Scanning Electronic Microscopic (SEM) 60× magnified picture of a Polyurethane/Felt synthetic resin leather.
Figure 7:
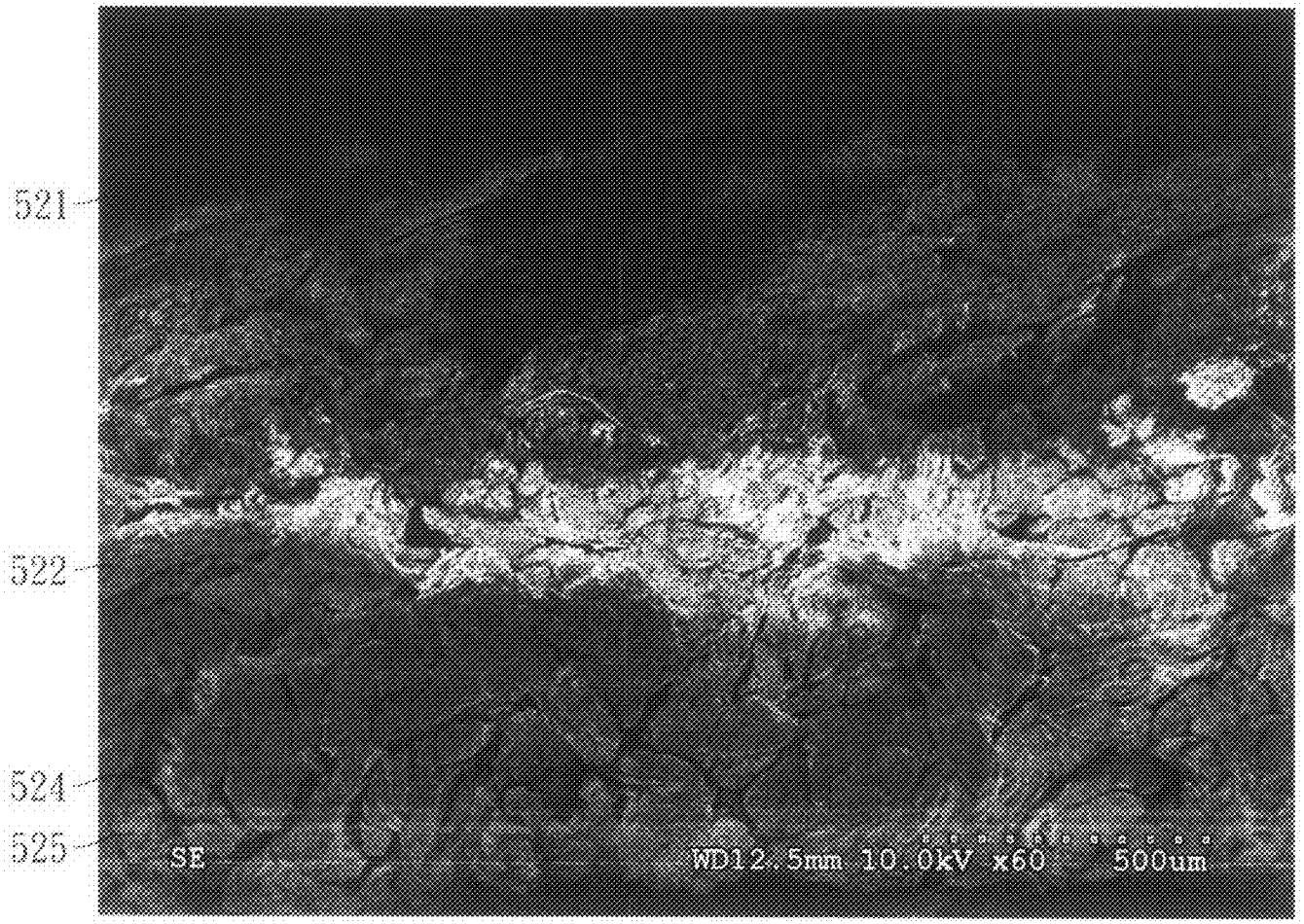
FIG. 7 is a Scanning Electronic Microscopic (SEM) 60× magnified picture of a natural leather.
Figure 8:
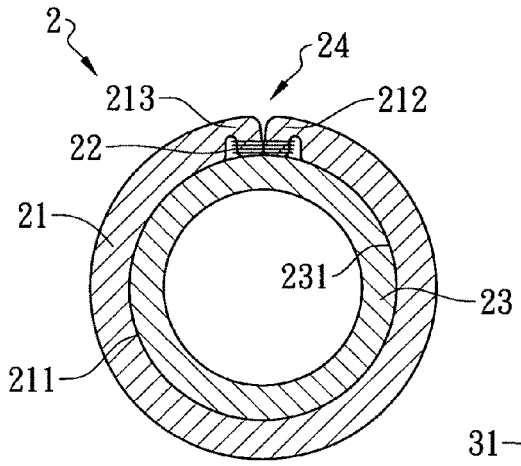
Fig. 8 Prior Art
FIG. 8 is a sectional view of another prior art, illustrating a sewn seam formed interiorly thereof.
Figure 10:
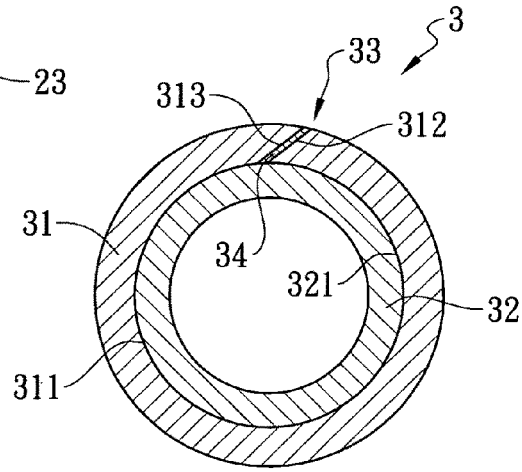
Fig. 10 Prior Art
FIG. 10 is a sectional view of the prior art's skived joint in FIG. 9.
Figure 9:
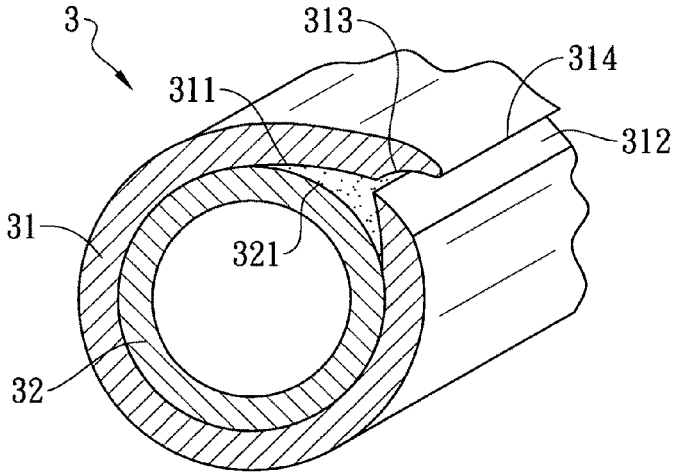
Fig. 9 Prior Art
FIG. 9 is a sectional view of another prior art's skived joint during a covering process.
Figure 11:
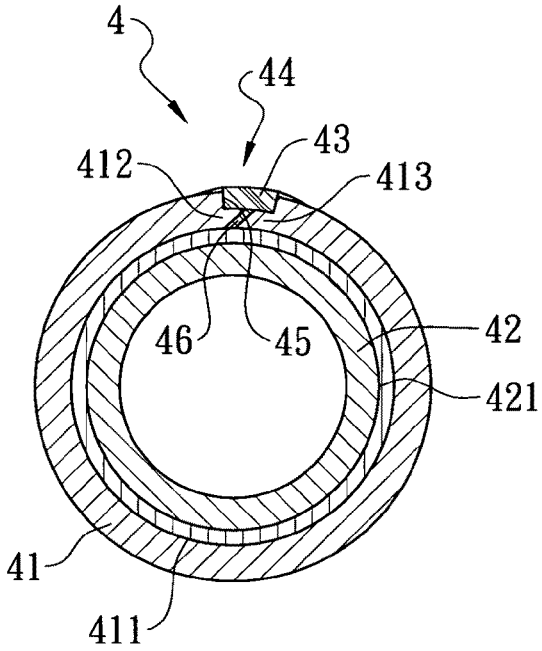
Fig. 11 Prior Art
FIG. 11 is a sectional view of another prior art.
Figure 12:
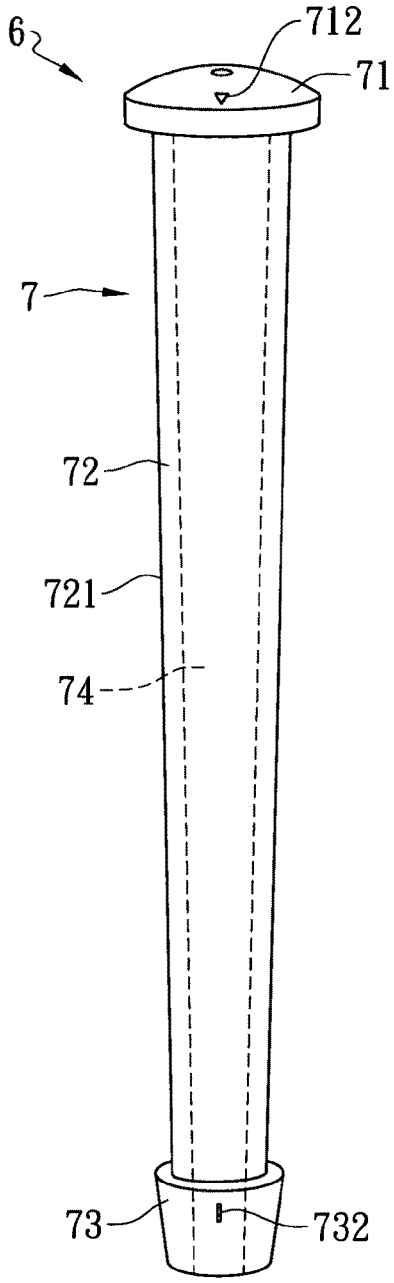
FIG. 12 illustrates an inner lining sleeve parts of a first embodiment of the present invention.

The inner lining sleeve 7 has an inner surface fitted around a golf club shaft and is made of resilient, expandable polymeric material such as natural rubber, rubber compound, thermoplastic elastomer (TPE), thermoplastic rubber (TPR), any suitable plastic, or closed-cell foams of plastic or rubber. The lining sleeve material is formed into a hollow tapered tubular body through a molding process. Referring to FIG. 12, the inner lining sleeve 7 includes a sleeve body 72 which is circular in cross-section throughout its length, a cap 71 projecting radially from the larger top end of the sleeve body 72 and closed with a vent hole, a protective rim 73 projecting radially from smaller end tip of the sleeve body 72 with an opening, a cavity 74 configured to receive the larger end of the golf club shaft, an outer surface 721 dimension of the sleeve body 72 tapered longitudinally from the cap 71 to the protective rim 73, and two alignment signs 712, 732 located respectively on the cap 71 and the protective rim 73.

Figure 13:
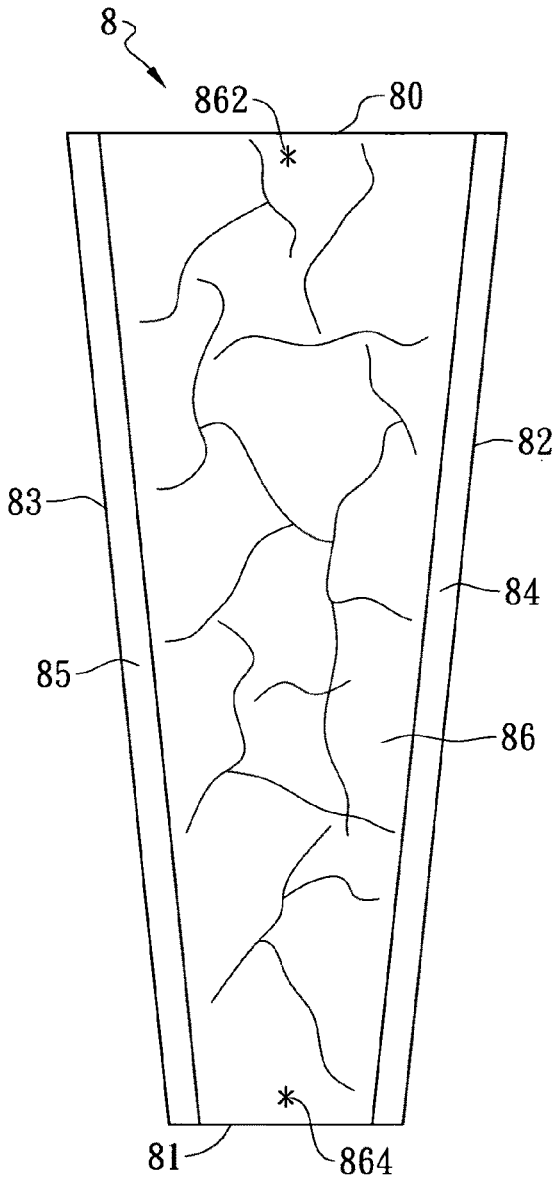
FIG. 13 illustrates a natural leather sheet's front side of the first embodiment of the present invention.
Figure 14:
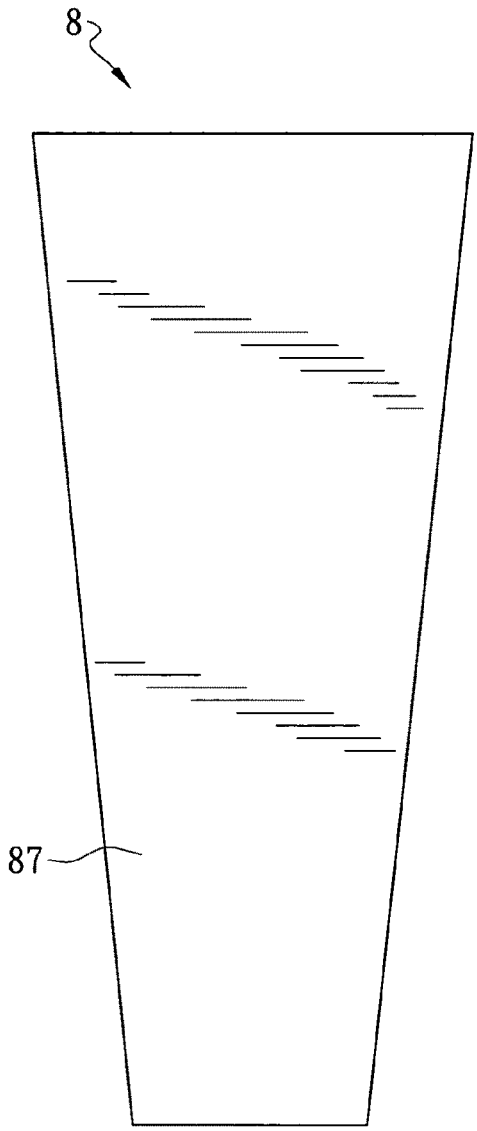
FIG. 14 illustrates the natural leather sheet's back side of the first embodiment of the present invention.

The single sheet layer 8 is made out of a natural leather material 52 which is the hide or skin of an animal put through a tanning process. The natural leather 52 includes cowhide, calf skin, deer skin, sheep skin, pig skin, fish skin, crocodile skin and other exotic animal skins. Preferably, they are cowhide, calf skin, deer skin, sheep skin, and pig skin. The natural leather 52 is composed of natural interweaving collagen fibres 525 which are enhanced and preserved through the tanning process. It has the grain surface layer 521 covered with the tight surface 523 with a brook web-like pattern and the inner reticular layer 522 composed of collagen fiber bundles 524. The structure of natural interweaving collagen fiber bundles 524 gives natural leather 52 the following: an unique soft, firm look and feel for slip resistance, a dense inner reticular layer for torque resistance, a durable gripping surface to be an excellent single sheet anti-slip material for the golf club grip 6. Referring to FIG. 13, the natural leather 52 is die cut into the sheet layer 8 material with a desired shape and a desired dimension for a desired golf club grip. This sheet layer 8 has two short top and bottom circumferential margins 80, 81 and two long axial margins 82, 83. The top circumferential margin 80 is wider in measurement than the bottom circumferential margin 81. The two axial margins 82, 83 are equal in length, interconnecting the top and bottom circumferential margins 80, 81 and edgily pressed to form two L-shaped corners 84, 85. Two central alignment signs 862, 864 are located on an outer surface 86 of the sheet layer 8 near to the top circumferential margin 80 and the bottom circumferential margin 81 respectively. The thickness of the natural leather sheet layer 8 is about 1.2 mm to 2.0 mm. Preferably the thickness of the sheet layer 8 is about 1.6 mm. The sheet layer 8 is bonded onto the outer surface 721 of the sleeve body 72 through a cement layer 78 which includes a high adhesion strength cement such as that made from a polycholoprene polymer. Referring to FIG. 14, an inner surface 87 of the sheet layer 8 has a dimension tapered longitudinally from the top circumferential margin 80 to the bottom circumferential margin 81. The inner surface 87 dimension of the sheet layer 8 is longitudinally narrower than the outer surface 721 dimension of the sleeve body 72 for about 0.2 mm to 2.0 mm in width measurement from the top circumferential margin 80 to the bottom circumferential margin 81.

Figure 15:
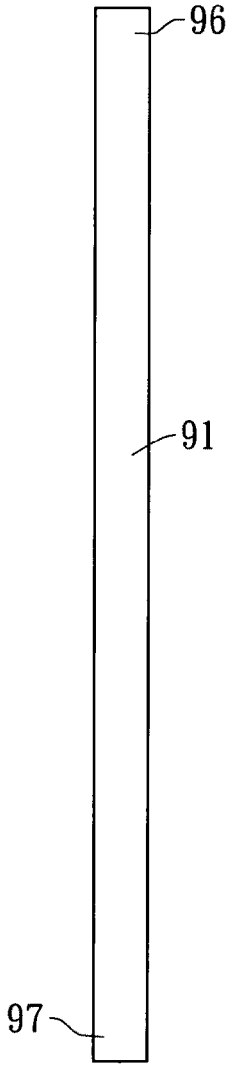
FIG. 15 illustrates a seam strip parts for the first embodiment of the present invention.

Referring to FIG. 15, the seam strip 91 can be selected from an elastic material group including Polyurethane, Vinyl, PVC, fabrics, textiles, and natural leathers. Preferably, the seam strip 91 is the natural leather 52. The seam strip 91 has a length extending from the top circumferential margin 80 to the bottom circumferential margin 81, a thickness of about 0.15 mm to 0.5 mm, and a width of about 3 mm to 6 mm. Preferably, the seam strip 91 has a thickness of about 0.4 mm and a width of about 4.5 mm.

Figure 16:
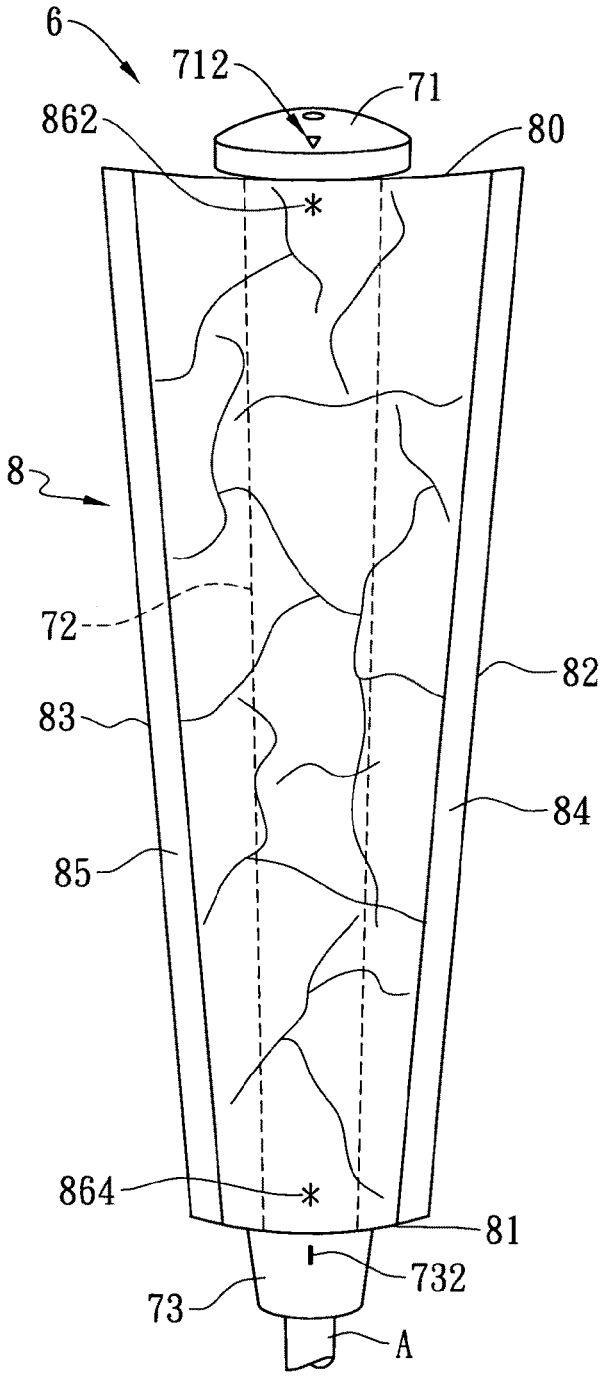
FIG. 16 is a front prospective view (from above) of a wrapping step during a first embodiment's assembly process of the present invention.
Figure 17:
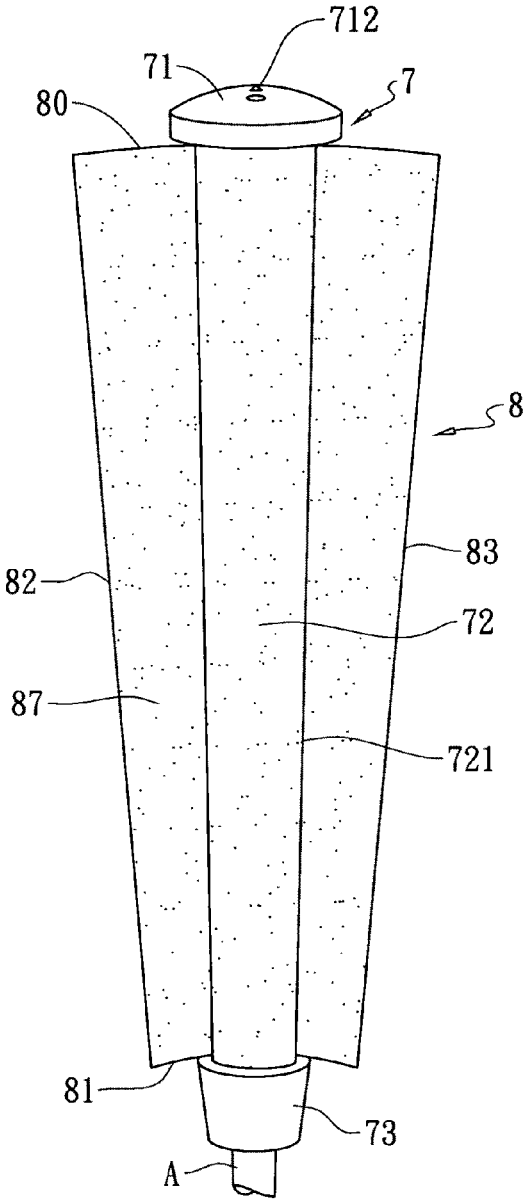
FIG. 17 is a bottom prospective view of another winding step during the first embodiment's assembly process of the present invention.
Figure 18:
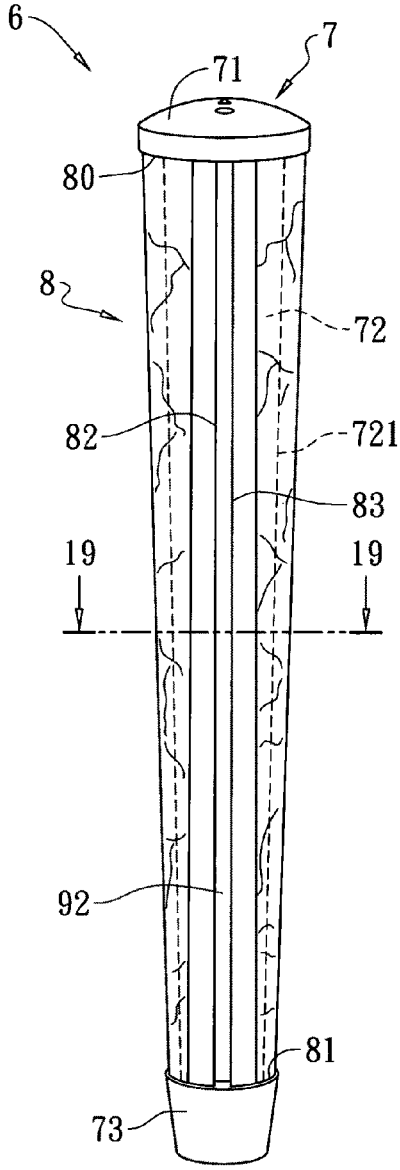
FIG. 18 is a prospective view of yet another winding step during the first embodiment's assembly process of the present invention.
Figure 19:
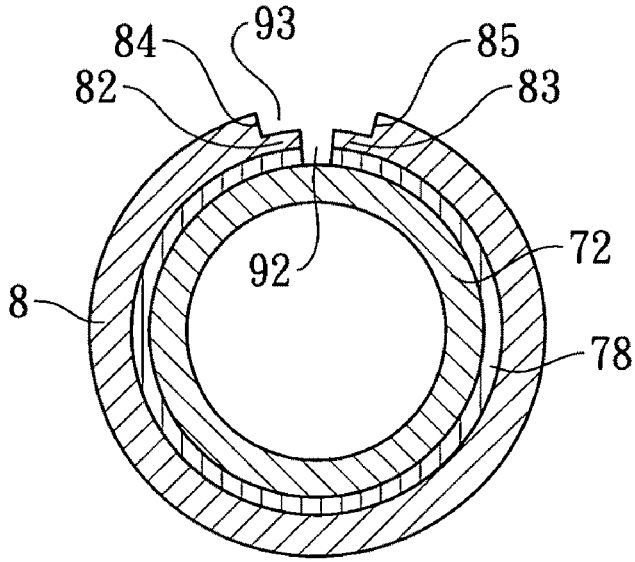
FIG. 19 is a cross sectional view of FIG. 18 taken along line 19-19.

In assembly, the inner lining sleeve 7 is mounted onto a rod (A) which provides a supporting force to the sleeve body 72. Then the cement is applied onto the outer surface 721 of the sleeve body 72 and the inner surface 87 of the sheet layer 8. The sleeve body 72 and the sheet layer 8 are adhered as described below. Referring to FIG. 16, the sheet layer's two central alignment signs 862, 864 are respectively lined up with the lining sleeve 7's two alignment signs 712 and 732 to place the central part of the sheet layer 8 onto the sleeve body 72. The bottom circumferential margin 81 is in abutment with the protective rim 73, whereas, the top circumferential margin 80 abuts against or proximate to the cap 71. Referring to FIG. 17 to 19, the sheet layer 8 is then wrapped around the sleeve body 72 in such a way that the two edgily pressed axial margins 82 and 83 are toward each other. The two axial margins 82, 83 form an axial gap 92 and an axial receiving groove 93. Due to the fact that the inner surface 87 dimension of the sheet layer 8 is longitudinally narrower than the outer surface 721 dimension of the sleeve body 72, the axial gap 92 is formed and is about 0.2 mm to 2.0 mm in width measurement between two axial margins 82, 83 that extend longitudinally from the top circumferential margin 80 to the bottom circumferential margin 81. The axial receiving groove 93 is formed above the axial gap 92 by the two axially pressed L-shaped corners 84, 85 of the two axial margins 82, 83 and wide enough to receive the seam strip 91.

Figure 20:
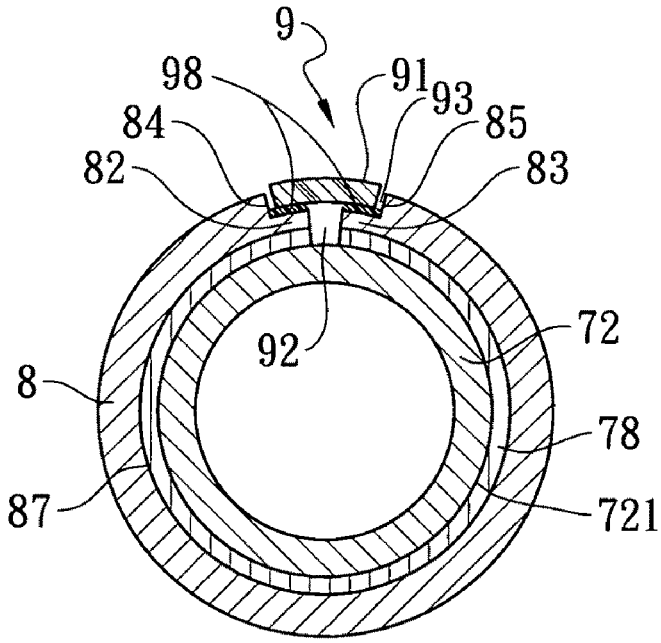
FIG. 20 is a cross sectional view of the first embodiment of the present invention.

Referring to FIG. 20, the seam strip 91 is then prepared and coated with the cement for inset bonding within the receiving groove 93 and is bonded onto each of the two axial margins 82, 83 covering the axial gap 92 to finish an axial seam structure 9. In the axial seam structure 9, there is a plurality of binding surfaces 98 between the seam strip 91 and each of two axial margins 82, 83 are about 1.0 mm to 2.9 mm in width measurement along each side of the axial gap 92 from the top circumferential margin 80 to the bottom circumferential margin 81.

The axial gap 92 separates two axial margins 82, 83 so that the uneven surfaces, such as the ridged surface 103 and the overlapped surface 104 will not occur during the production of the grip 6. Therefore, the problem of improper inset bonding the seam strip 91 that leads to the production of a defective grip as encountered in the prior art grip 1 is alleviated. This increases the rate of production of good quality products and reduces the amount of defective products, thereby lowering the cost of production. The axial gap 92 also provides an open space that is needed to enhance the expansion capacity of the sleeve body 72 in an effort to not only ease installation but also to increase the maximum grip size attainable by applying additional build up tape. The problem of limiting the sleeve body's expansion which occurs in the prior arts grip 2, 3, 4 will be solved by providing the axial gap 92 within the axial seam structure 9. Due to the two axial margins 82, 83 that are edgily pressed, the binding surfaces 98 along each side of the axial gap 92 are flat and wide enough, about 1.0 mm to 2.9 mm wide as mentioned above, to produce an effective bonding strength between the seam strip 91 and each of the two axial margins 82, 83. On top of that, the elasticity of the seam strip 91 and the open space of the axial gap 92 will release the burst tension occurred along the axial seam of the single sheet layer 8. Therefore, the axial seam structure 9 has the seam strip 91 and the plurality of flat binding surfaces 98 along the axial gap 92 together to be strong enough to hold a denser material such as a single natural leather sheet to give the grip 6 a soft, firm look and feel for slip resistance, a dense structure for torque resistance, and a durable gripping surface. The problem of prior art the grip 1, which is limited to have Polyurethane to be an anti-slip sheet layer, is overcome. Therefore, the object of the invention, a single sheet natural leather golf club grip with an improved axial seam structure, is accomplished.

Figure 21:
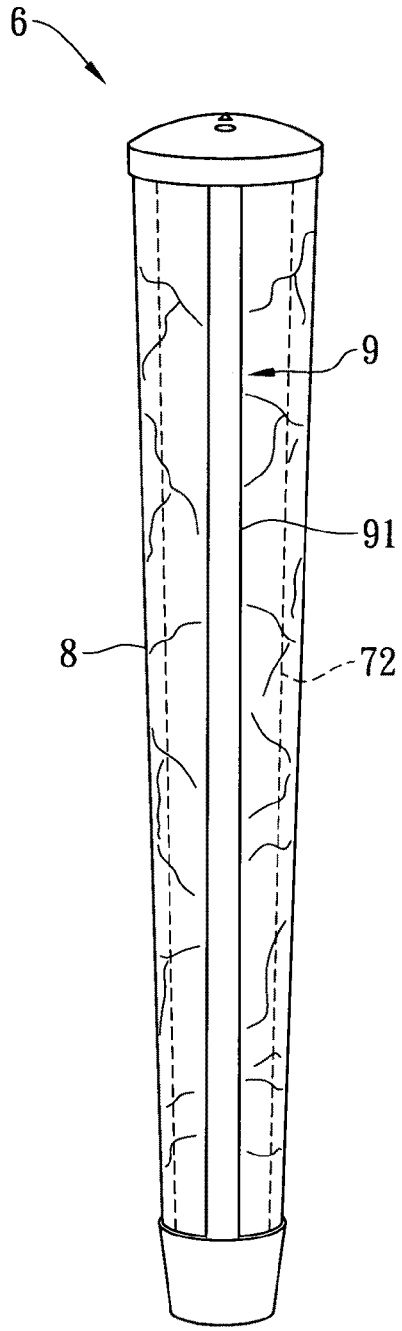
FIG. 21 is a prospective view of the first embodiment of the present invention.

This single sheet natural leather golf club grip 6 utilizes a natural leather seam strip 91 to finish the axial seam structure 9 that will feature a complete unique soft, firm look and feel for slip resistance. Another object of the invention is thus accomplished. FIG. 21 shows a prospective view of the first embodiment with the axial seam structure 9 having the axial gap 92 covered by the seam strip 91.

Figure 22:
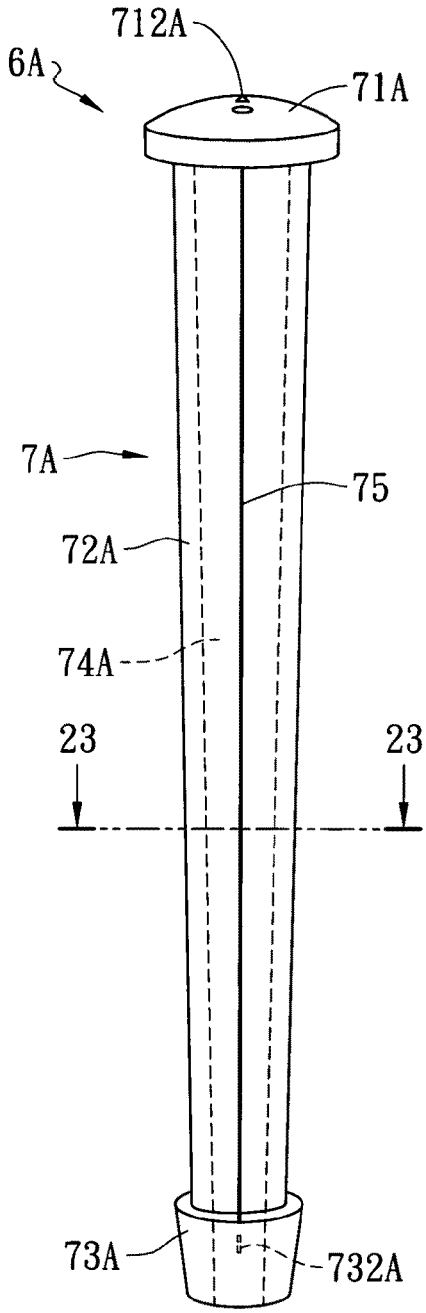
FIG. 22 illustrates the back side of a modified inner lining sleeve parts for a second embodiment of the present invention.
Figure 23:
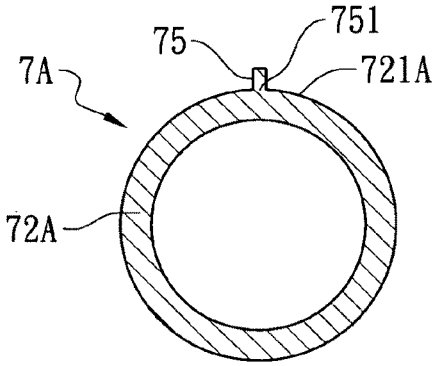
FIG. 23. is a cross sectional view of FIG. 22 taken along line 23-23.
Figure 24:
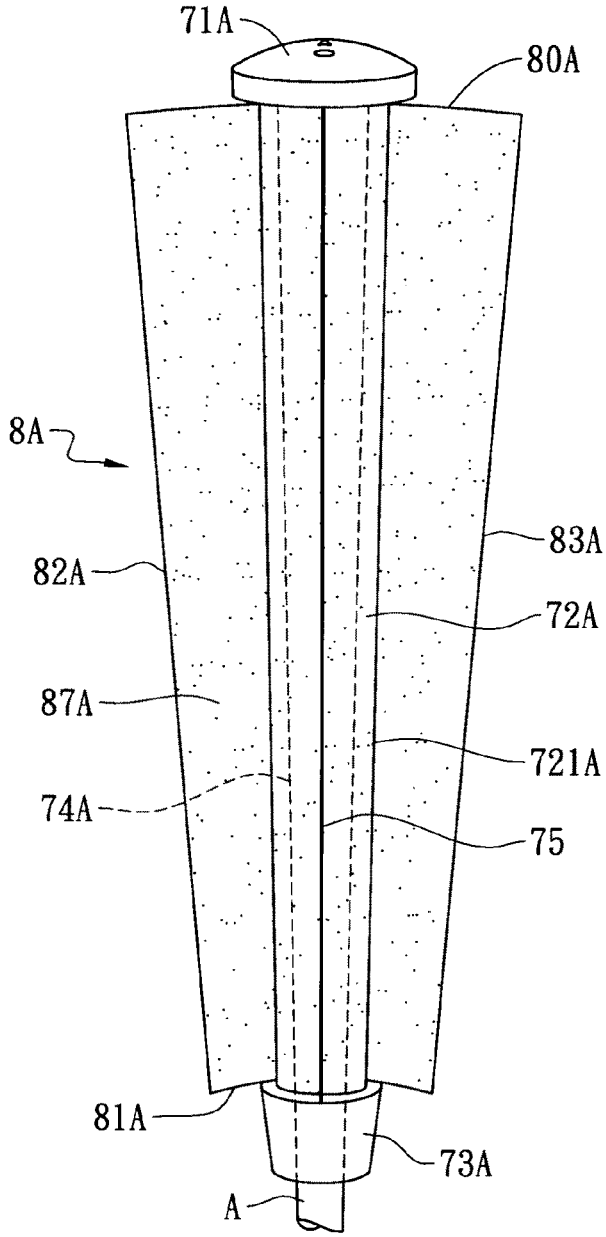
FIG. 24. is a bottom prospective view of a winding step of the second embodiment's assembly process of the present invention FIG. 25. is a prospective view of yet another winding step during the second embodiment's assembly process of the present invention.
Figure 25:
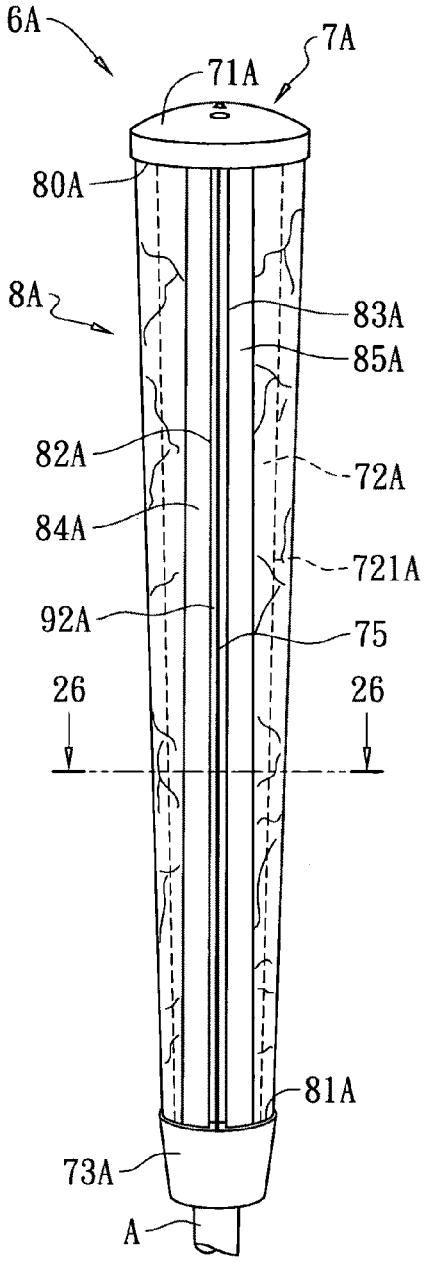
Figure 26:
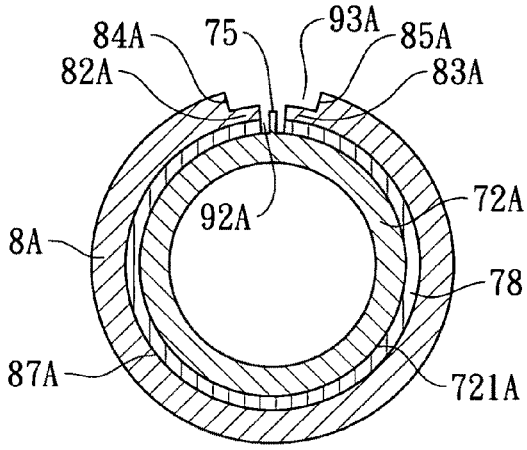
FIG. 26. is a cross sectional view of FIG. 25 taken along line 26-26.

In order to surely achieve the separation of two axial margins of a single sheet layer, the present invention may utilize the construction of a second embodiment shown in FIGS. 22 to 28. The second embodiment is provided based on the construction of the first embodiment and has a modified inner lining sleeve 7A, a modified single natural leather sheet layer 8A, a modified axial seam structure 9A. Referring to FIGS. 22 and 23, the lining sleeve 7A is similar to the lining sleeve 7 of the first embodiment except that the lining sleeve 7A includes a raised rib 75 and a modified outer surface 721A of a sleeve body 72A. The raised rib 75 is extending axially from a cap 71A to a protective rim 73A and projecting radially from the outer surface 721A of the sleeve body 72A. The raised rib 75 has a height which is lower than the thickness of the sheet layer 8A's two edgily pressed axial margins 82A, 83A, and is from the outer surface 721A of the sleeve body 72A of about 0.2 mm to 1.6 mm high. The raised rib further has an integral connected area 751 which is connected with the sleeve body 72A, wherein the integral connected area 751 is of about 0.2 to 1.6 mm wide extending axially from the cap 71A to the protective rim 73A. The raised rib 75 is located diametrically opposite to the position of the two alignment signs 712A, 732A respectively located at the cap 71A and the protective rim 73A. The outer surface 721A of the sleeve body 72A excludes the area of the raised rib 75's integral connected area 751 and has a dimension tapered longitudinally from the cap 71A to the protective rim 73A. Referring to FIGS. 24 to 26, the sheet layer 8A has a top circumferential margin 80A, a bottom circumferential margin 81A, two axial margins 82A, 83A, and is similar to the sheet layer 8 of the first embodiment except that the sheet layer 8A has an inner surface 87A dimension longitudinally narrower than the outer surface 721A dimension of the sleeve body 72A in a width measurement of about 0.2 mm to 1.6 mm from the top circumferential margin 80A to the bottom circumferential margin 81A.

Figure 27:
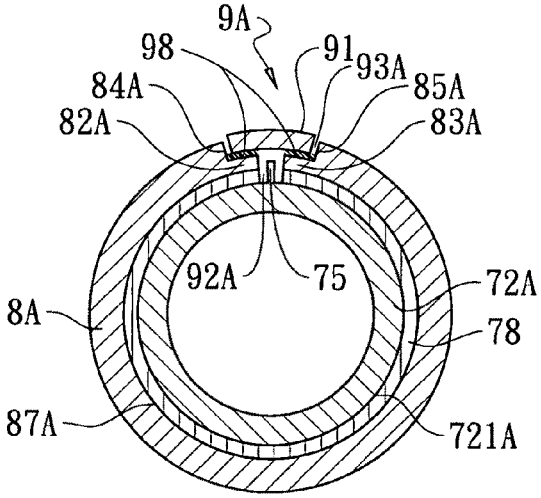
FIG. 27 is a cross sectional view of the second embodiment of the present invention.
Figure 28:
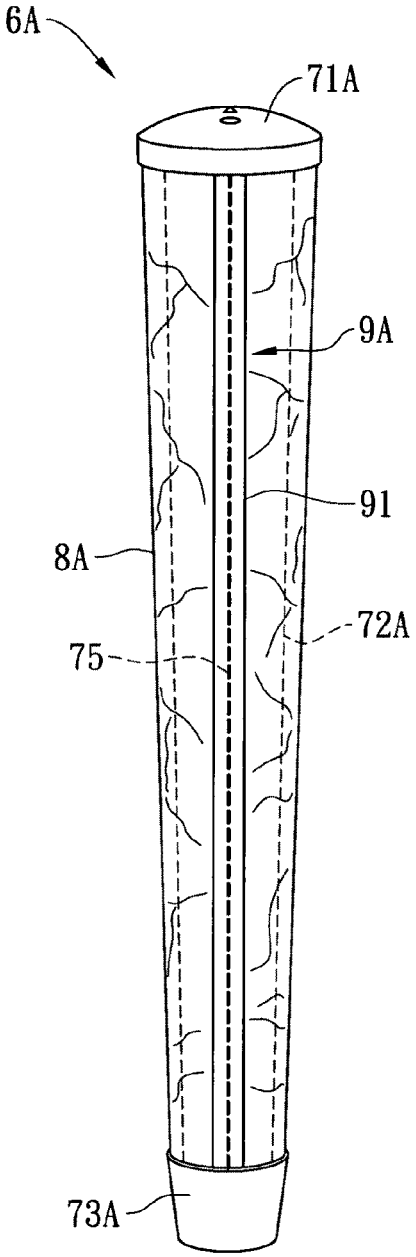
FIG. 28 is a prospective view of the second embodiment of the present invention.

Referring to FIGS. 24 to 27, the second embodiment's process to wrap and adhere the sheet layer 8A onto the sleeve body 72A is also substantially similar to the first embodiment's assembling process except the particular step of wrapping the sheet layer 8A around the sleeve body 72A and the other step of the seam strip 91 inset bonding. After the central part of the sheet layer 8A is placed onto the sleeve body 72A, the sheet layer 8A is wrapped around the sleeve body 72A to have the axial margin 83A along one side of the raised rib 75 and have the axial margin 82A along the opposite side of the raised rib 75. Referring to FIGS. 26 and 27, two edgily pressed axial margins 82A and 83A are toward each other along each side of the raised rib 75 to form an axial gap 92A having the raised rib 75 inside its gap. The axial gap 92A is about 0.4 mm to 2 mm wide from the top circumferential margin 80A to the bottom circumferential margin 81A. The seam strip 91, which has been coated with the cement, is placed over the axial gap 92A and the raised rib 75 within the receiving groove 93A to be inset bonded onto each of the two axial margins 82A, 83A to finish the modified axial seam structure 9A. A golf club grip 6A is then formed. FIG. 28 is a prospect view of the second embodiment, showing the grip 6A with the axial seam structure 9A having the axial gap 92A and the raised rib 75 covered by the seam strip 91.

As compared with the first embodiment, the construction of the second embodiment has the same advantages of the first embodiment and further assure the separation of the two axial margins 82A, 83A. The raised rib 75 has a height lower than the two axial margins 82A, 83A' thickness to provide an even binding surface for the seam strip 91's inset bonding process and acts as a barrier to prevent the two axial margins 82A, 83A colliding together with a face to face relationship or the ridged surface 103 or the overlapped surface 104, due to the elasticity of the sheet layer 8A. Therefore, the uneven binding surface such as the ridged surface 103, the overlapped surface 104 will not occur during the production of the grip 6A. The problem of improper inset bonding the seam strip 91 leads to make a defective grip as encountered in the prior art grip 1 is alleviated. This increases the rate of production of good quality product and reduce the amount of defective products, thereby lowering the cost of production. The axial gap 92A and the raised rib 75 provide a separated space that is needed to enhance the expansion capacity of the sleeve body 72A in an effort to not only ease installation but also to increase the maximum grip size attainable by applying additional build up tape. The problem of limiting the sleeve body's expansion which occurs in the prior arts grip 2, 3,4 will be solved by the second embodiment's construction.

Figure 29:
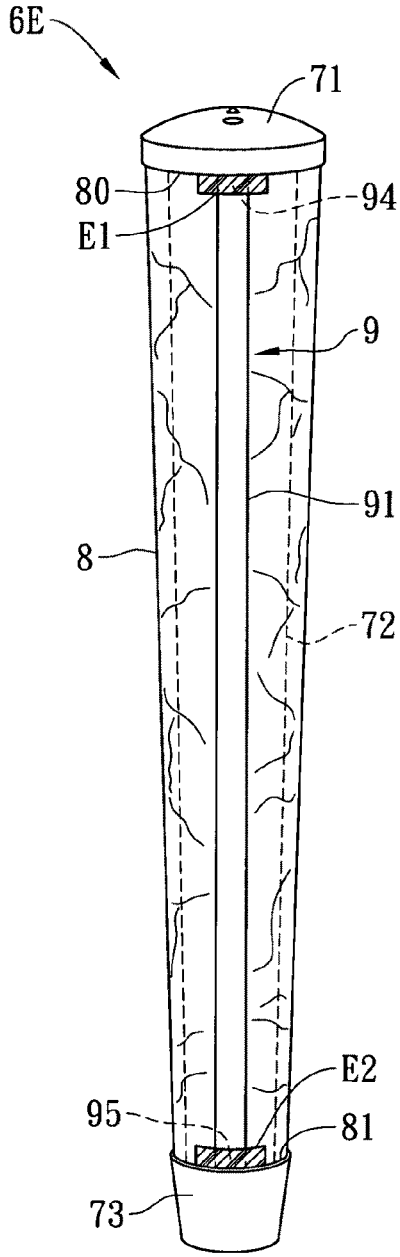
FIG. 29 is a prospective view of a third embodiment of the present invention.
Figure 30:
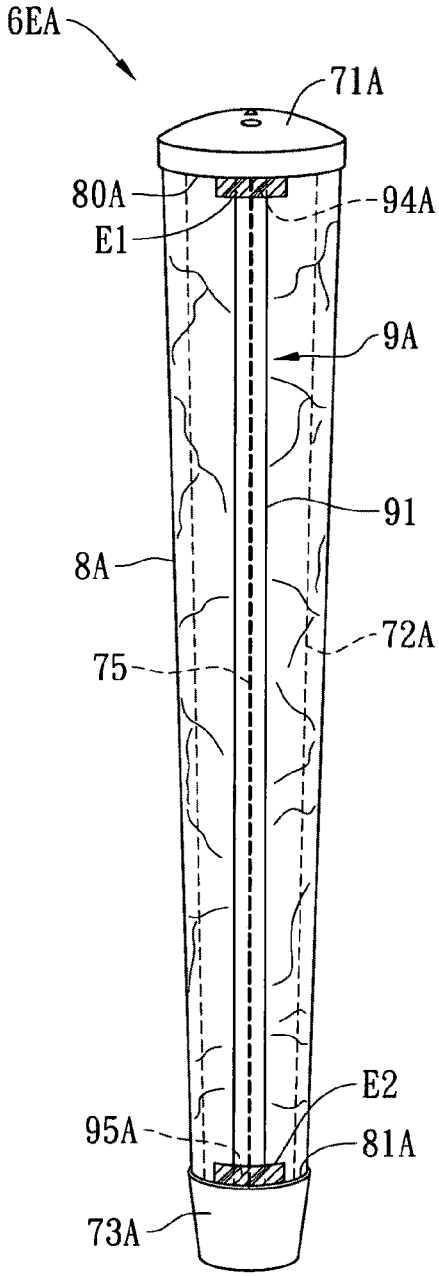
FIG. 30 is a prospective view of a fourth embodiment of the present invention.

To reinforce the top 94, 94A and bottom 95, 95A ends of first and second embodiment's axial seam structure 9 and 9A, there are three possible methods as:

1.) Sealant (E): Referring to FIG. 29, a third embodiment of the present invention is based on the first embodiment and with a plurality of sealant deposits E. The sealant deposits E are made out of polymeric materials that include hot melt glue, polyurethane sealant, instant glue, and other polymeric glues. The most preferred polymeric material that is used is the hot melt glue. The hot melt glue is deposited to form a first sealant deposit E1 at the spot having the top end 94 of the first embodiment axial seam structure 9 and the top portion of said sheet layer 8 connected with each other. The first sealant deposit E1 strengthens the top end 94 of the first embodiment axial seam structure 9. Similarly, the hot melt glue is deposited to form a second sealant deposit E2 at another spot having the bottom end 95 of the first embodiment axial seam structure 9 and the bottom portion of the sheet layer 8 connected with each other. The second sealant deposit E2 strengthens the bottom end 95 of the first embodiment axial seam structure 9. FIG. 29 illustrates the first embodiment with the sealant deposits E1, E2 to form a golf club grip 6E of the present invention. FIG. 30 exhibits a fourth embodiment of the present invention based on the second embodiment, having the addition of the raised rib 75 and a similar plurality of sealant deposits E1 and E2. The top 94A and bottom 95A ends of the axial seam structure 9A are strengthened by the sealant deposits E1, E2 to form a golf club grip 6EA of the present invention.

Figure 31:
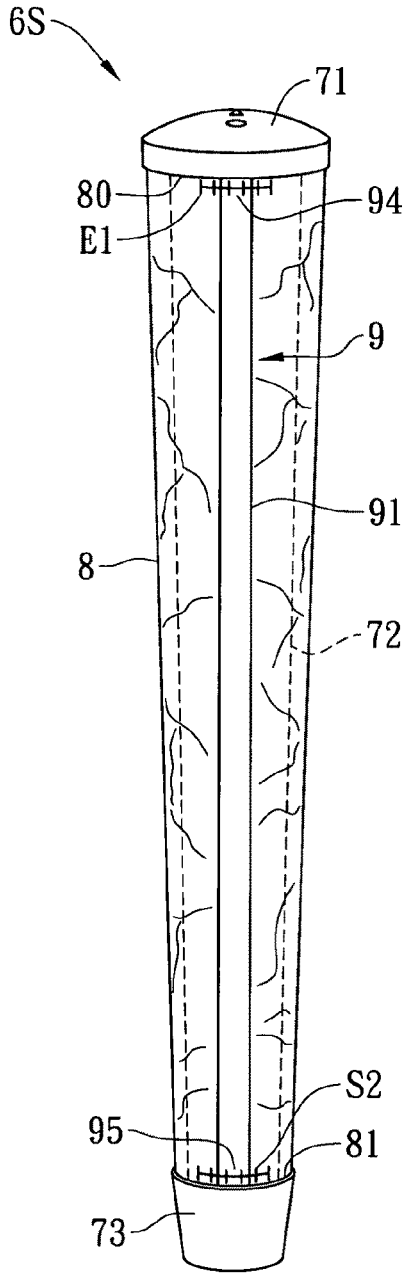
FIG. 31 is a prospective view of a fifth embodiment of the present invention.
Figure 32:
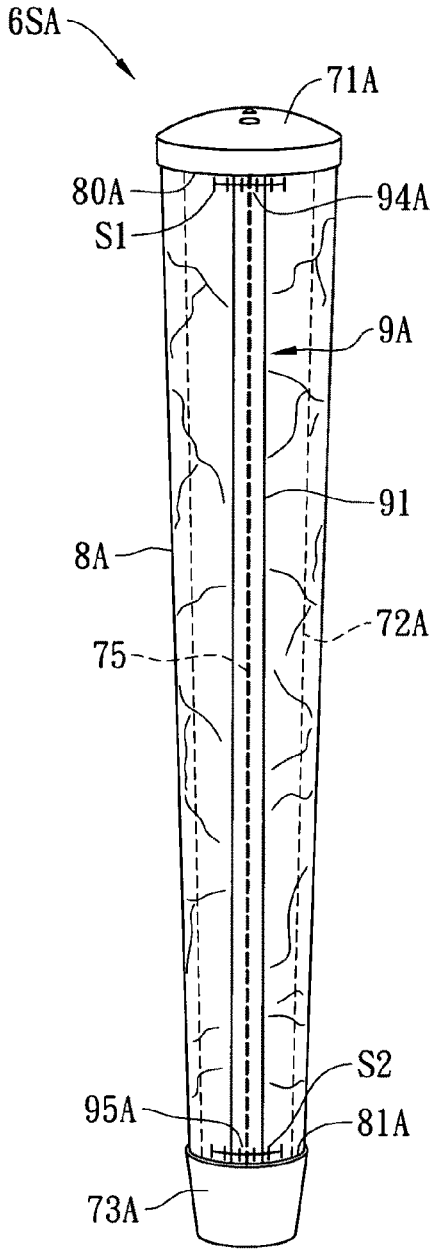
FIG. 32 is a prospective view of a sixth embodiment of the present invention.

2.) Sewn (S): Referring to FIG. 31, a fifth embodiment of the present invention is based on the first embodiment with a plurality of sewn ties S. A first sewn tie S1 is formed by sewing at the spot having the top end 94 of the first embodiment axial seam structure 9 and the top portion of said sheet layer 8 connected with each other. The first sewn tie S1 strengthens the top end 94 of the first embodiment axial seam structure 9. Similarly, a second sewn tie S2 is formed by sewing at the spot having the bottom end 95 of the first embodiment axial seam structure 9 and the bottom portion of said sheet layer 8 connected with each other. The second sewn tie S2 strengthens the bottom end 95 of the first embodiment axial seam structure 9. FIG. 31 displays the first embodiment with the sewn ties S1 and S2 to form a golf club grip 6S of the present invention. Referring to FIG. 32, a sixth embodiment of the present invention is based on the second embodiment with the similar sewn ties S1, S2. The axial seam structure 9A, which has the addition of the raised rib 75, has its top 94A and bottom 95A ends strengthened by the sewn ties S1, S2 to form a golf club grip 6SA of the present invention.

Figure 33:
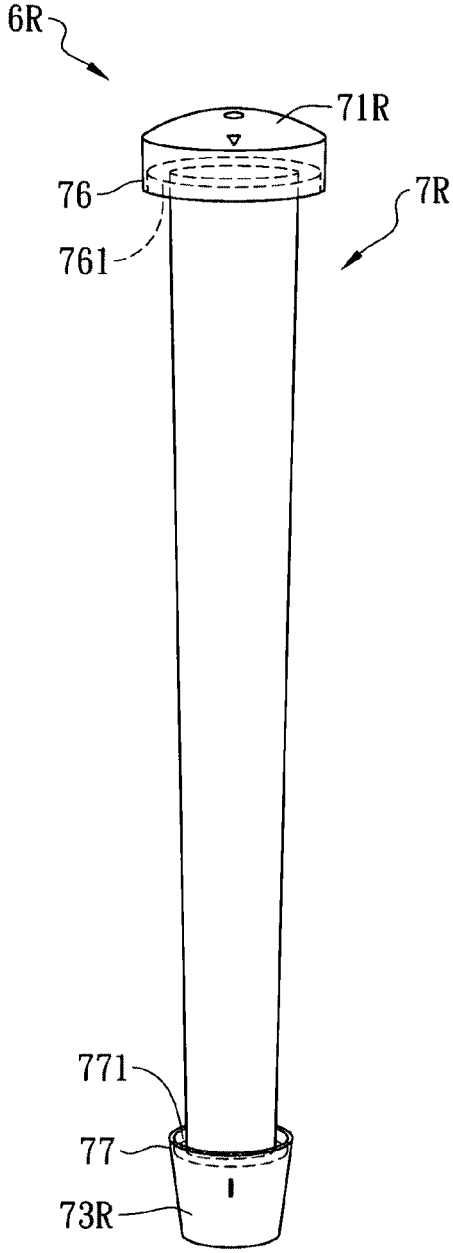
FIG. 33 illustrates a modified inner lining sleeve parts for a seventh embodiment of the present invention.
Figure 34:
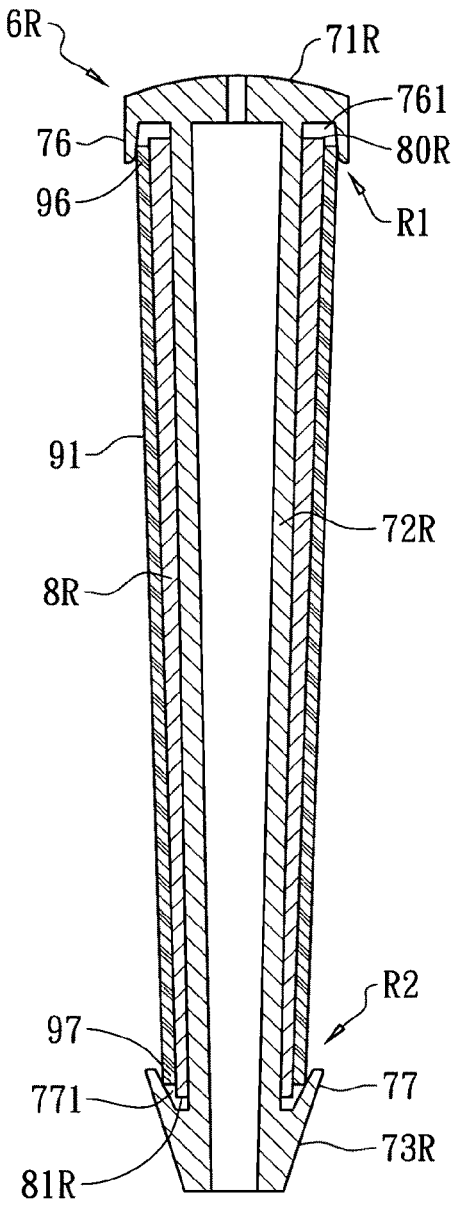
FIG. 34 is a longitudinal sectional view along an axial seam structure of the seventh embodiment of the present invention.
Figure 35:
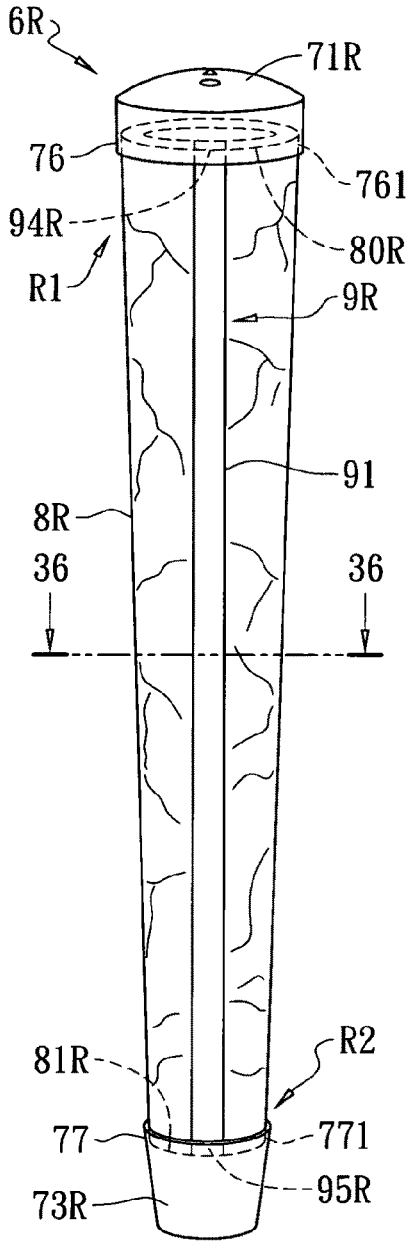
FIG. 35 is a prospective view of the seventh embodiment of the present invention.
Figure 36:
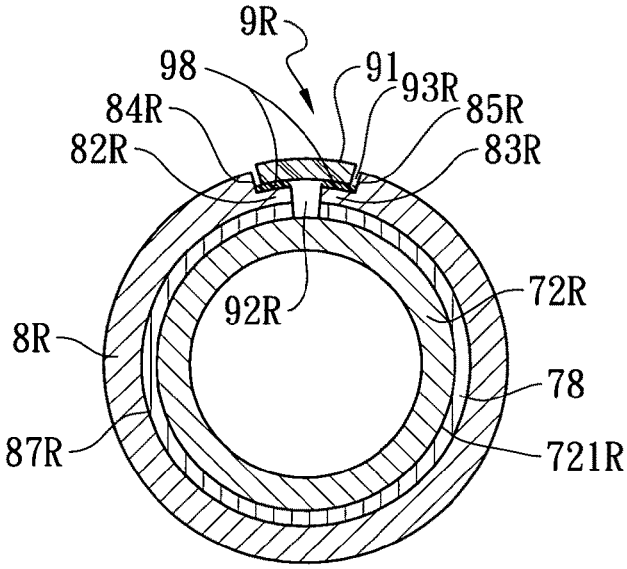
FIG. 36 is a cross sectional view of FIG. 35 taken along line 36-36.

3.) Receiving:

Referring to FIGS. 33 to 36, a seventh embodiment of the present invention is provided based on the construction of the first embodiment with a plurality of receiving reinforcements R1, R2 and has a modified inner lining sleeve 7R, a modified single natural leather sheet layer 8R, a modified axial seam structure 9R. FIG. 36 shows a cross section view of the seventh embodiment (a golf grip 6R)'s construction which is similar to the first embodiment (the golf grip 6)'s construction. Referring to FIG. 33, the inner lining sleeve 7R is similar to the inner sleeve 7 of the first embodiment except that the inner lining sleeve 7R further includes a first skirt part 76 projecting axially from a cap 71R toward a protective rim 73R, an annual annular recess 761 defined by the cap 71R and the first skirt part 76, a second skirt part 77 projecting axially from the protective rim 73R to the cap 71R, and an additional annular recess 771 defined by the protective rim 73R and the second skirt part 77. Referring to FIG. 34, the sheet layer 8R is similar to the sheet layer 8 of the first embodiment except that a bottom circumferential margin 81R of the sheet layer 8R is proximate to the protective rim 73R and within the additional annular recess 771, whereas, a top circumferential margin 80R of the sheet layer 8R is proximate to the cap 71R and within the annular recess 761.

In assembly, the process is substantially in the similar manner which is for the first embodiment except the particular step of wrapping the sheet layer 8R around the sleeve body 72R of the inner lining sleeve 7R and the other particular step of the seam strip 91 inset bonding. After the sheet layer 8R is wrapped around the sleeve body 72R, the bottom circumferential margin 81R is inserted into the additional annular recess 771 of the protective rim 73R and the top circumferential margin 80R is inserted into the annular recess 761 of the cap 71R. After the seam 91 is inset bonded within the receiving groove 93R, the bottom end 97 of the seam strip 91 is then inserted into the additional annular recess 771 to finish a bottom end 95R of the modified axial seam structure 9R. The second skirt 77 and the additional annular recess 771 form a second receiving reinforcement R2 connected with the protective rim 73R. The second receiving reinforcement R2 covers and strengthens the bottom end 95R of the axial seam structure 9R and the bottom circumferential margin 81R. Next, the top end 96 of the seam strip 91 is inserted into the annular recess 76 to finish a top end 94R of the modified axial seam structure 9R. The first skirt part 76 and the annular recess 761 form a first receiving reinforcement R1 connected with the cap 71R. The first receiving reinforcement R1 covers and strengthens the top end 94R of the axial seam structure 9R and the top circumferential margin 80R. FIG. 34 shows the longitudinal sectional view along the axial seam structure 9R of the seventh embodiment of the present invention which is a golf club grip 6R having a plurality of receiving reinforcements R1 and R2. A prospective view of the seventh embodiment of the present invention is shown in FIG. 35.

Figure 37:
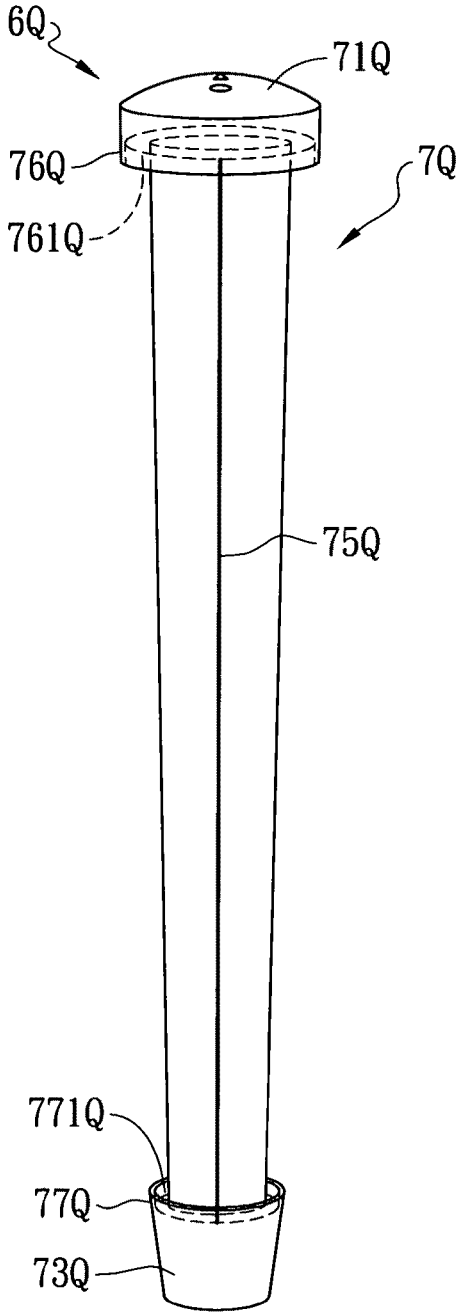
FIG. 37 illustrates the back side of another modified inner lining sleeve parts for a eighth embodiment of the present invention.
Figure 38:
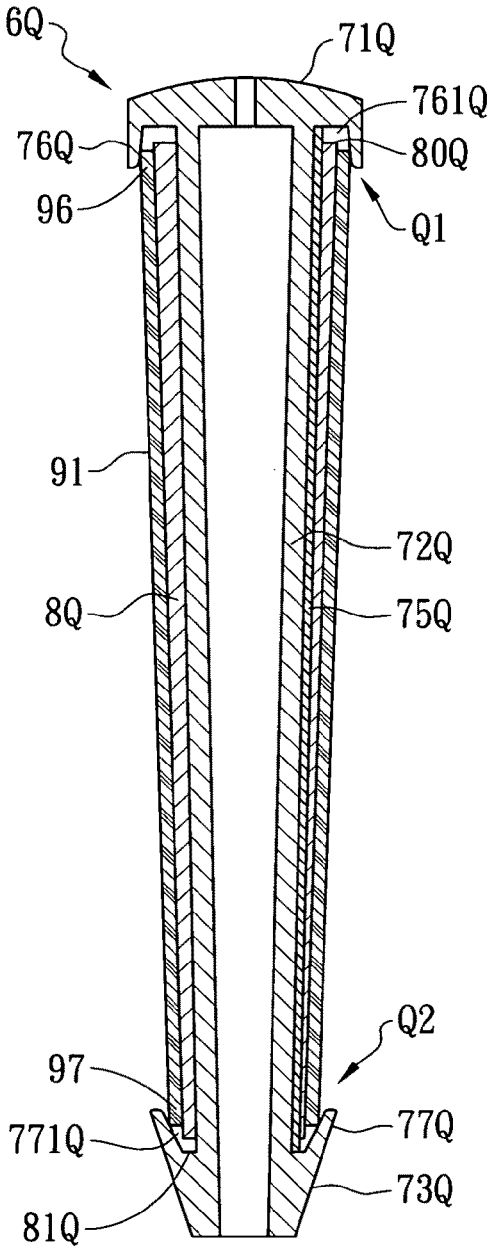
FIG. 38 is a longitudinal sectional view along an axial seam structure of the eighth embodiment of the present invention.
Figure 39:
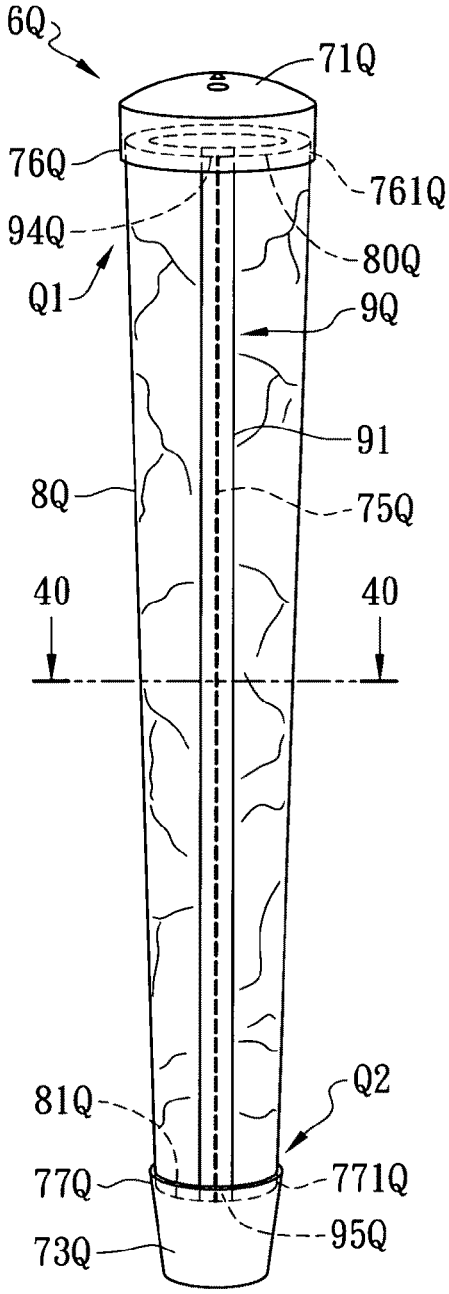
FIG. 39 is a prospective view of the eighth embodiment of the present invention.
Figure 40:
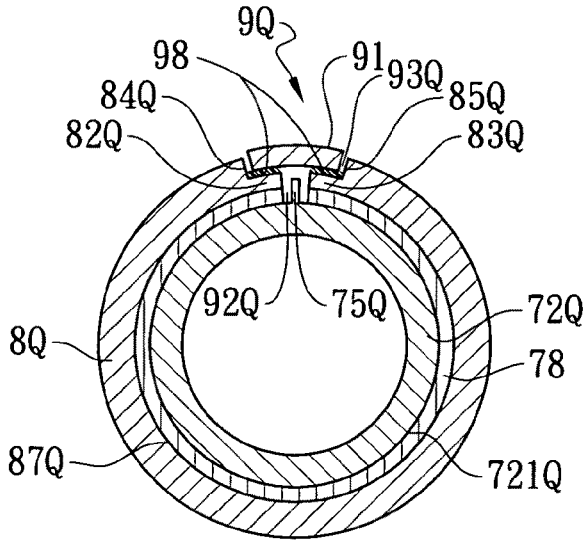
FIG. 40 is a cross sectional view of FIG. 39 taken along line 40-40.
Figure 41:
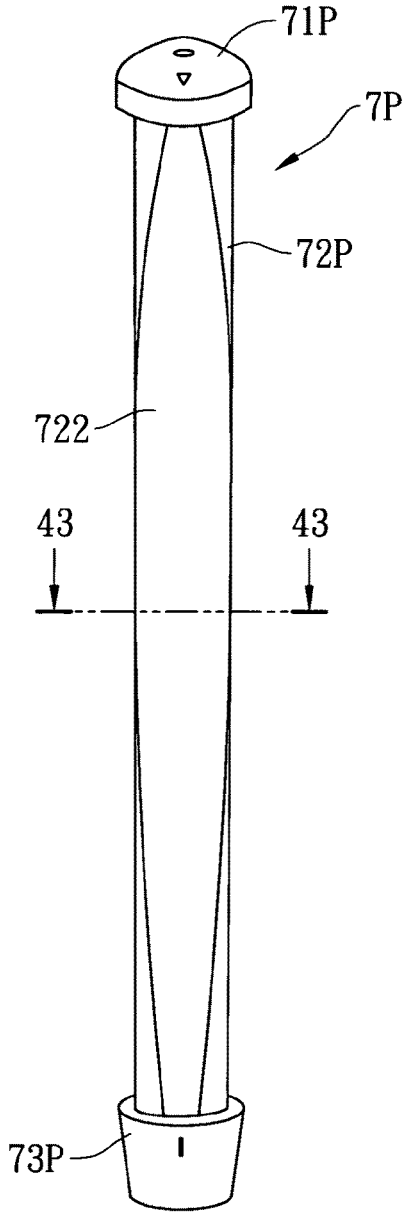
FIG. 41 illustrates the front side of another modified inner lining sleeve parts for a ninth embodiment putter grip of the present invention.
Figure 42:
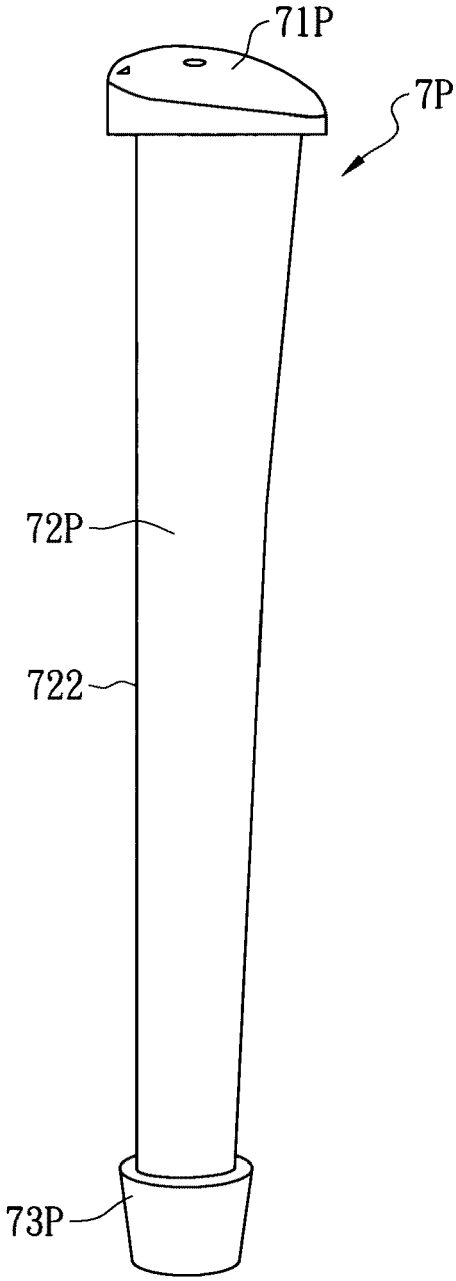
FIG. 42 illustrates the side view of the modified inner ling sleeve parts for the ninth embodiment putter grip of the present invention.
Figure 43:
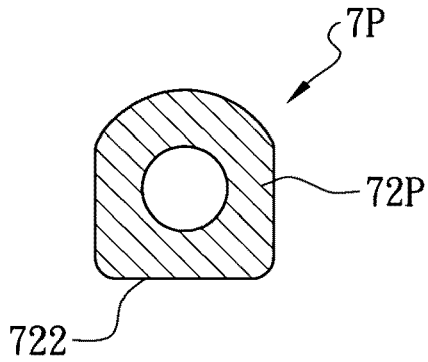
FIG. 43 is a cross sectional view of FIG. 41 taken along line 43-43.

Referring to FIGS. 37 to 40, an eighth embodiment is provided based on the second embodiment with a plurality of receiving reinforcements Q1, Q2 and further has a modified inner sleeve 7Q, a modified single natural leather sheet layer 8Q, and a modified axial seam structure 9Q. FIG. 40 shows a cross section view of the eighth embodiment (a golf club grip 6Q)'s construction which is similar to the second embodiment (the grip 6A)'s construction. Referring to FIG. 37, the inner lining sleeve 7Q is similar to the inner lining sleeve 7A of the second embodiment except that the inner lining sleeve 7Q not only possesses the raised rib 75 but also has a first skirt part 76Q projecting axially from a cap 71Q toward a protective rim 73Q, an annular recess 761Q defined by the cap 71Q and the first skirt part 76Q, a second skirt part 77Q projecting axially from the protective rim 73Q to the cap 71Q, and the additional annular recess 771Q defined by the protective rim 73Q and the second skirt part 77Q. Referring to FIG. 38, the sheet layer 8Q is similar to the sheet layer 8A of the second embodiment except that a bottom circumferential margin 81Q of the sheet layer 8Q is proximate to the protective rim 73Q and within the additional annular recess 771Q, whereas, a top circumferential margin 80Q of the sheet layer 8Q is proximate to the cap 71Q and within the annular recess 761Q.

In assembly, the process is also similar to the second embodiment except the particular step of wrapping the sheet layer 8Q and the other particular step of the seam strip 91 inset bonding. After the sheet layer 8Q is wrapped around a sleeve body 72Q with two axial margins 82Q, 83Q respectively along each side of the raised rib 75Q, the bottom circumferential margin 81Q is then inserted into the additional annular recess 771Q of the protective rim 73Q. The top circumferential margin 80Q is inserted into the annular recess 761Q of the cap 71Q. After the seam strip 91 is inset bonded within a receiving groove 93Q, the bottom end 97 of the seam strip 91 is then inserted into the additional annular recess 771Q of the protective rim 73Q. The second skirt 77Q and the additional annular recess 771Q thus form a second receiving reinforcement Q2 connected with the protective rim 73Q. This second receiving reinforcement Q2 covers and strengthens a bottom end 95Q of an axial seam structure 9Q and the bottom circumferential margin 81Q. Next, the top end 96 of the seam strip 91 is inserted into the annular recess 761Q. The first skirt part 76Q and the annular recess 761Q form a first receiving reinforcement Q1 connected with the cap 71Q. The first receiving reinforcement Q1 covers and strengthens a top end 94Q of the axial seam structure 9Q and the top circumferential margin 80Q. FIG. 38 shows a longitudinal sectional view along the axial seam structure 9Q of the eighth embodiment of the present invention which is the grip 6Q having a plurality of receiving reinforcements Q1 and Q2. A prospective view of the eighth embodiment of the present invention golf club grip 6Q is shown in FIG. 39.

Figure 44:
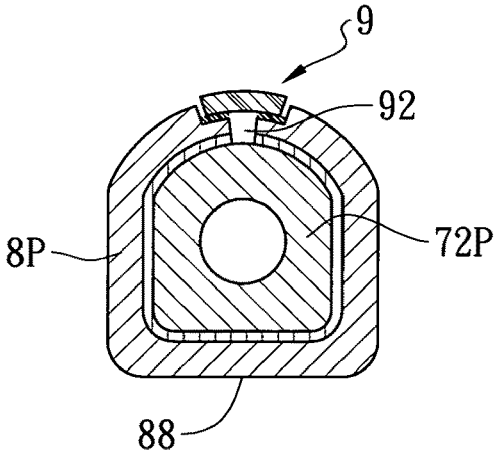
FIG. 44 is a cross sectional view of the ninth embodiment of the present invention.
Figure 45:
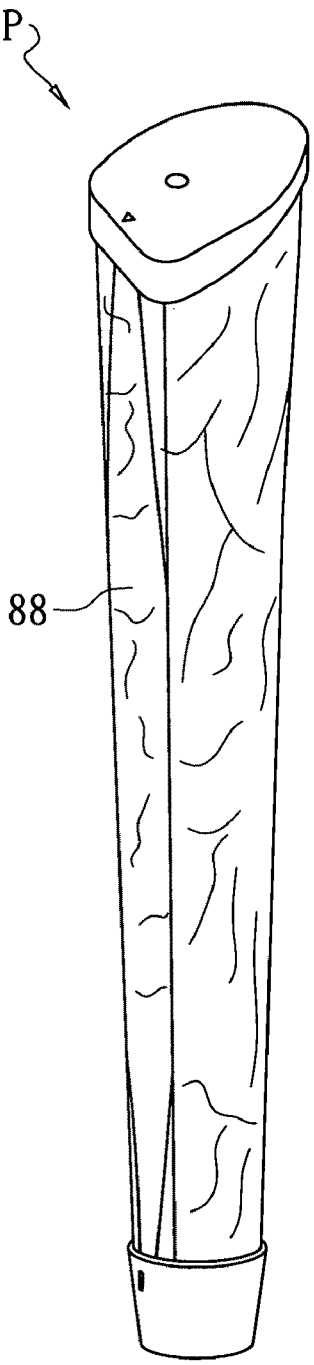
FIG. 45 is a prospective view of the ninth embodiment putter grip of the present invention.
Figure 46:
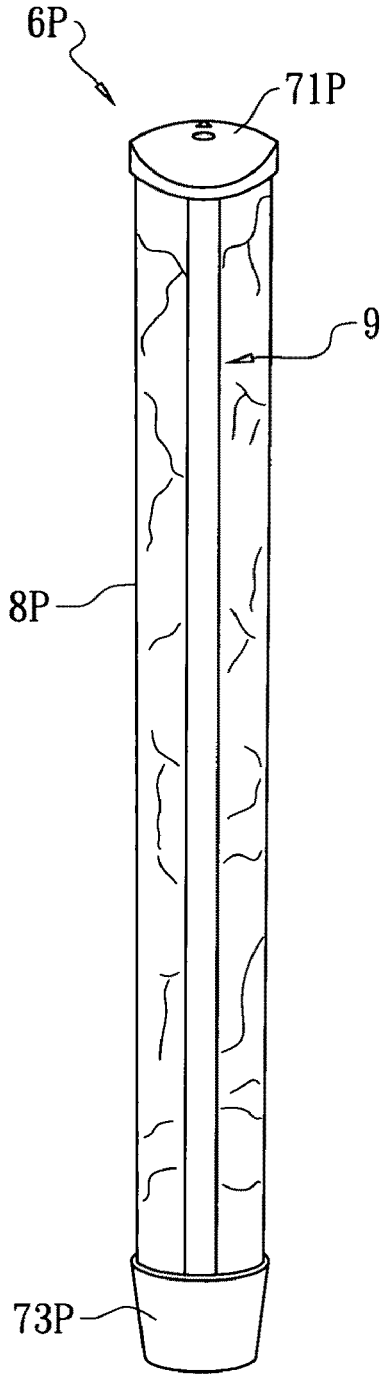
FIG. 46 is a rear prospective view of FIG. 45.

Referring to FIGS. 41 to 46, a ninth embodiment of the present invention is a golf club grip 6P for a conventional putter use. The grip 6P is substantially similar to the first embodiment except that the inner lining sleeve 7 is modified into an inner lining sleeve 7P which has a non-circular cross-sectional sleeve body 72P with a flat front area 722. The configuration of the flat front area 722 is in accordance with the design of most putters in general use. In assembly, the steps to wrap, adhere the single sheet layer 8P onto to the sleeve body 72P and to form an axial seam structure 9 are in the same processes for the first embodiment. Referring to FIGS. 44 and 45, the ninth embodiment, which is the golf club putter grip 6P, has a flat front area 88 configured as for the conventional putter grips.

Figure 47:
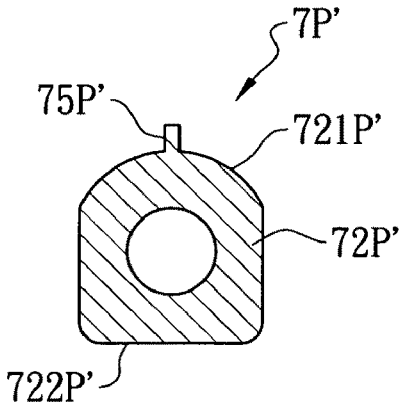
FIG. 47 is a cross sectional view of another modified inner lining sleeve parts for an tenth embodiment putter grip of the present invention.
Figure 48:
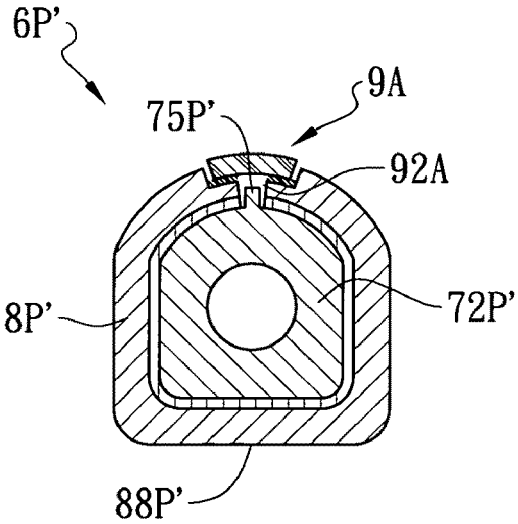
FIG. 48 is a cross sectional view of the tenth embodiment putter grip of the present invention.
Figure 49:
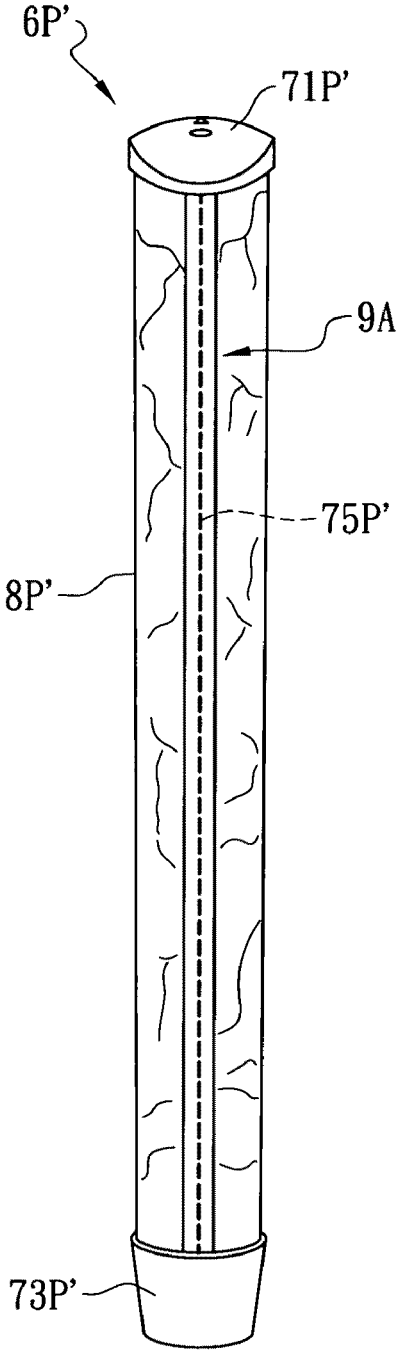
FIG. 49 is a rear prospective view of the tenth embodiment putter grip of the present invention.

Referring to FIGS. 47 to 49, a tenth embodiment of the present invention is a golf club grip 6P' for the use of the conventional putter. Referring to FIGS. 47 and 48, the golf club putter grip 6P' includes almost all of the same elements of the second embodiment except that the inner lining sleeve 7' is modified into an inner lining sleeve 7P' which not only has the raised rib 75 to form an axial seam structure 9A but also has a non-circular cross-sectional sleeve body 72P with the flat front area 722P'. The configuration of the flat front area 722P' is the same as mentioned in the ninth embodiment. Referring to FIGS. 48 and 49, the tenth embodiment, which is the golf club putter grip 6P', has a flat front area 88P' configured as for the conventional putter grips and the axial seam structure 9A.

The present invention has been described in connection with what is considered the most practical and preferred embodiment. It is understood that this invention is not limited to the disclosed embodiment but is also intended to cover various arrangements included within the spirit and scope of the broadest interpretation so as to encompass all such modifications and equivalent arrangements.

We claim:

1. A golf club grip, comprising:

a lining sleeve, which includes a sleeve body having top and bottom ends, a cap projecting radially from said top end, a protective rim projecting radially from said bottom end, a cavity configured to receive a larger end of a golf club shaft; and a single natural leather sheet layer, wrapped around and adhered to said sleeve body, said sheet layer having a bottom circumferential margin being in abutment with said protective rim, a top circumferential margin proximate to said cap, two axial margins which interconnect the top and bottom circumferential margins and which are pressed to form two L-shaped corners, an inner surface dimension tapered longitudinally from said top circumferential margin to said bottom circumferential margin, wherein said lining sleeve further includes a raised rib projecting radially from said sleeve body and extending axially from said cap to said protective rim and having a height from an outer surface of said sleeve body being lower than the thickness of the two axial margins, wherein said raised rib has a integral connected area connected with said sleeve body, wherein said outer surface of said sleeve body excludes said integral connected area of said raised rib, and has a dimension tapered longitudinally from said cap to said protective rim wherein the inner surface dimension of said sheet layer is longitudinally narrower than the outer surface dimension of said sleeve body, wherein said sheet layer has the two axial margins which are toward each other along each side of said raised rib to form an axial gap with said raised rib between the two axial margins and from said top circumferential margin to said bottom circumferential margin and to form a receiving groove between said two L-shaped corners from said top circumferential margin to said bottom circumferential margin; and a seam strip, covering said axial gap and said raised rib, and inset bonded onto each of the two axial margins within said receiving groove to finish an axial seam structure.

2. The golf club grip as claimed in claim 1, wherein said top circumferential is in abutment with said cap.

3. The golf club grip as claim 2, wherein said lining sleeve is made of rubber, rubber compounds, thermoplastic elastomer (TPE), thermoplastic rubber (TPR), elastomers, or closed-cell foams of plastics or rubbers.

4. The golf club grip as claimed in claim 1, wherein said raised rib has a height being about 0.2 mm to 1.60 mm from the outer surface of said sleeve body.

5. The golf club grip as claimed in claim 1, wherein said natural leather sheet is through a tanning process.

6. The golf club grip as claimed in claim 5, wherein said natural leather sheet includes cowhide, calf skin, deer skin, sheep skin, pig skin, crocodile skin, and fish skin.

7. The golf club grip as claimed in claim 6, wherein said natural leather sheet has a grain surface layer and a reticular layer.

8. The golf club grip as claimed in claim 1, wherein said axial gap is about 0.4 mm to 2.0 mm in width measurement between said two axial margins and from said top circumferential margin to said bottom circumferential margin.

9. The golf club grip as claimed in claim 1, wherein said seam strip is made of a elastic material selected from a group of polyurethane, vinyl, PVC, fabrics, other elastic textiles, and natural leathers.

10. The golf club grip as claimed in claim 1, wherein said axial seam structure includes a plurality of flat binding surfaces between said seam strip and each of the two axial margins being about 1.0 mm to 2.9 mm in width measurement respectively along each side of said axial gap, whereby said axial seam structure includes said seam strip and said plurality of flat binding surfaces along each side of the axial gap together to firmly hold said single natural leather sheet layer to give the grip a soft, firm look and feel for slip resistance, a dense structure for torque resistance, and a durable gripping surface.

11. The golf club grip as claimed in claim 2, further comprising a plurality of polymeric sealant deposits including a first polymeric sealant deposit formed at the spot having the top end of said axial seam structure and the top portion of said sheet layer connected with each other, and a second polymeric sealant deposit formed at another spot having the bottom end of said seam structure and the bottom portion of said sheet layer connected with each other, whereby said plurality of polymeric sealant deposits strengthen the top and bottom ends of said axial seam structure.

12. The golf club grip as claimed in claim 2, further comprising a plurality of sewn ties including a first sewn tie formed at the spot having the top end of said axial seam structure and the top portion of said sheet layer connected with each other, and a second sewn tie formed at another spot having the bottom end of said seam structure and the bottom portion of said sheet layer connected with each other, whereby said plurality of sewn ties strengthen the top and bottom ends of said axial seam structure.

* * * * *